US010151129B2

(12) United States Patent
Bacchetti

(10) Patent No.: US 10,151,129 B2
(45) Date of Patent: Dec. 11, 2018

(54) LOW-BULKINESS HYDRAULIC HINGE

(71) Applicant: IN & TEC S.R.L., Brescia (IT)

(72) Inventor: Luciano Bacchetti, Nave (IT)

( * ) Notice: Subject to any disclaimer, the term of this patent is extended or adjusted under 35 U.S.C. 154(b) by 0 days.

(21) Appl. No.: 15/713,629

(22) Filed: Sep. 23, 2017

(65) Prior Publication Data

US 2018/0010377 A1 Jan. 11, 2018

Related U.S. Application Data

(63) Continuation of application No. 15/113,421, filed as application No. PCT/IB2015/050603 on Jan. 27, 2015, now Pat. No. 9,810,012.

(30) Foreign Application Priority Data

Jan. 27, 2014 (IT) ..... VI2014A0021

(51) Int. Cl.
*E05D 7/08* (2006.01)
*E05F 3/10* (2006.01)
*E05F 3/20* (2006.01)

(52) U.S. Cl.
CPC ..... *E05F 3/104* (2013.01); *E05F 3/10* (2013.01); *E05F 3/20* (2013.01); *E05Y 2201/638* (2013.01); *E05Y 2800/268* (2013.01)

(58) Field of Classification Search
CPC ... Y10T 16/552; Y10T 16/5525; Y10T 16/56; Y10T 16/593; Y10T 16/2769; Y10T 16/2771; Y10T 16/2774; Y10T 16/283; Y10T 16/304; E05F 3/104; E05F 3/10; E05F 3/20; E05F 3/225; E05F 3/227; E05Y 2201/638; E05Y 2800/268; E05Y 2900/132; E05Y 2600/452; E05Y 2600/41; E05D 7/086; E05D 7/10
See application file for complete search history.

(56) References Cited

U.S. PATENT DOCUMENTS 2,603,818 A * 7/1952 Carlson ..... E05F 3/10 16/229
3,657,766 A * 4/1972 Peterson ..... E05D 3/022 16/281
4,649,598 A * 3/1987 Kinsey ..... E05F 1/025 16/81
4,763,384 A * 8/1988 Watabe ..... E05F 3/104 16/53

(Continued)

*Primary Examiner* — Chuck Y Mah
(74) *Attorney, Agent, or Firm* — Themis Law

(57) ABSTRACT

A hinge for cold rooms or glass shutters includes a stationary support structure and a shutter movable between an open position and a closed position. The hinge includes a hinge body with a working chamber; a pivot coupled with the hinge body; a cam element unitary with the pivot; a plunger element sliding in the working chamber, the plunger element having a slider with an operative face interacting with the cam element; a counteracting elastic member acting on the plunger element to move it between a position proximal to the bottom wall of the working chamber and a position distal therefrom. The hinge body has a substantially plate-like shape. The cam element includes an elongated appendix extending from the pivot to come in contact engagement with the operative face of the slider. The pivot is placed at one of the side walls of the working chamber.

12 Claims, 20 Drawing Sheets

(56) References Cited

U.S. PATENT DOCUMENTS

| | | | | |
|---|---|---|---|---|
| 8,307,496 | B2 * | 11/2012 | Wu | E05F 3/108 16/49 |
| 8,910,345 | B2 * | 12/2014 | Bland | E05F 1/00 16/71 |
| 2002/0066157 | A1 * | 6/2002 | Chen | E05F 3/104 16/58 |
| 2005/0177975 | A1 * | 8/2005 | Wang | E05F 1/1292 16/60 |
| 2008/0127452 | A1 * | 6/2008 | Jackson | E05F 1/1253 16/50 |
| 2010/0024159 | A1 * | 2/2010 | Oh | E05D 5/0246 16/54 |
| 2011/0219583 | A1 * | 9/2011 | Bacchetti | E05D 11/1014 16/54 |
| 2013/0185896 | A1 * | 7/2013 | Yu | E05F 3/104 16/55 |
| 2014/0075718 | A1 * | 3/2014 | Bacchetti | E05F 3/104 16/54 |

* cited by examiner 10
12
17'
40
11
16
14''
19'
17''
60
31
650
51'
14'
600
51''
20
X≡Y
π'≡π''
35
19
59
17''
64
65
60
62''
36
61
610
53
62'
51'
16
51''
31
650
63
54

LOW-BULKINESS HYDRAULIC HINGE

FIELD OF THE INVENTION

The present invention is generally applicable to the technical field of closing and/or checking hinges, and particularly relates to a low-bulkiness hydraulic hinge.

BACKGROUND OF THE INVENTION

As known, the hinges generally comprise a movable element, usually fixed to a door, a shutter or the like, pivoted upon a fixed element, generally fixed to the support frame thereof.

Particularly, hinges usually used for cold rooms or glass shutters are high-bulkiness, unaesthetic and with low performances.

From documents U.S. Pat. No. 7,305,797, US2004/206007 and EP1997994 hinges are known in which the action of the closing means that ensure the return of the shutter in the closed position is not counteracted. Consequently, there is the risk of the crashing of the shutter against the support frame, the shutter getting damaged.

From documents EP0407150 and FR2320409 door closers are known including hydraulic damping means to damp the action of the closing means. These known devices are extremely high-bulkiness and, consequently, they necessarily need to be fixed on the floor.

Therefore, the installation of such devices necessarily requires expensive and difficult break-in working on the floor, such works being to be made by specialized operators.

As a consequence, it is clear that such door closers are not susceptible to be assembled on the stationary support structure or on the shutter of cold rooms.

From the German patent DE3641214 an automatic closing device for window shutters is known designed to be mounted on the outer side thereof.

SUMMARY OF THE INVENTION

Object of the present invention is to overcome at least partially the above mentioned drawbacks, by providing an hinge having high performances, simple construction and low cost.

Another object of the invention is to provide an extremely low-bulkiness hinge.

Another object of the invention is to provide a hinge that can be inserted between the shutter and the stationary support frame of a cold room.

Another object of the invention is to provide a hinge ensuring the automatic closing of the door from the open door position.

Another object of the invention is to provide a hinge ensuring the controlled movement of the door to which it is coupled, in the open and/or closed position.

Another object of the invention is to provide a hinge suitable to support even heavy doors and shutters, without varying the behavior and with no need of maintenance.

Another object of the invention is to provide a hinge with a minimum number of constructing parts.

Another object of the invention is to provide a hinge capable to maintain the exact closed position overtime.

Another object of the invention is to provide an extremely safe hinge, which does not oppose resistance if pulled.

Another object of the invention is to provide a hinge that is extremely easy to install.

These objects, as well as other which will appear hereafter, are fulfilled by a hinge having one or more of the features herein disclosed, shown and/or claimed.

Advantageous embodiments of the invention are defined in accordance with the dependent claims.

BRIEF DESCRIPTION OF THE DRAWINGS

Further features and advantages of the invention will appear more evident reading the detailed description of some preferred not-exclusive embodiments of a hinge 1, which are shown as a non-limiting examples with the help of the annexed drawings, wherein.

DETAILED DESCRIPTION OF SOME PREFERRED EMBODIMENTS

With reference to the above figures, the hinge according to the invention, generally indicated 1, has a low bulkiness, and therefore is useful where there is a limited space to install the hinge or where it is desirable to use a low-bulkiness hinge for aesthetic purposes.

As an example, the hinge 1 may be used for cold rooms, or may be integrated in the tubular frame thereto. As a further example, hinge 1 may be used for glass shutters, such as those of a shop window or a showcase.

Figure 1A:
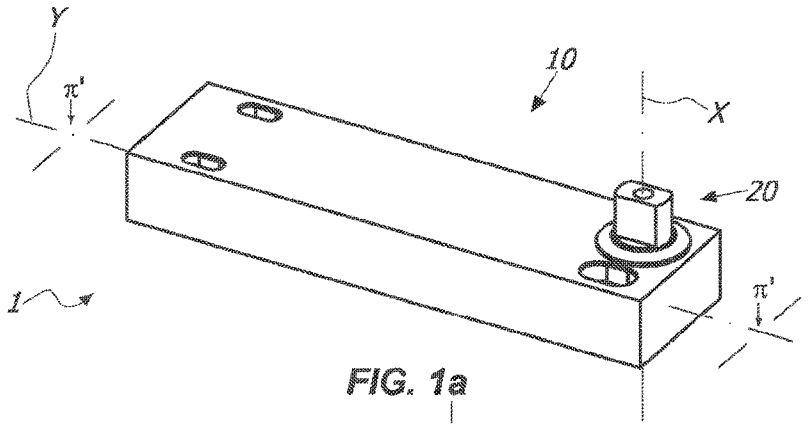
FIG. 1*a* is an axonometric view of the hinge 1.
Figure 1B:
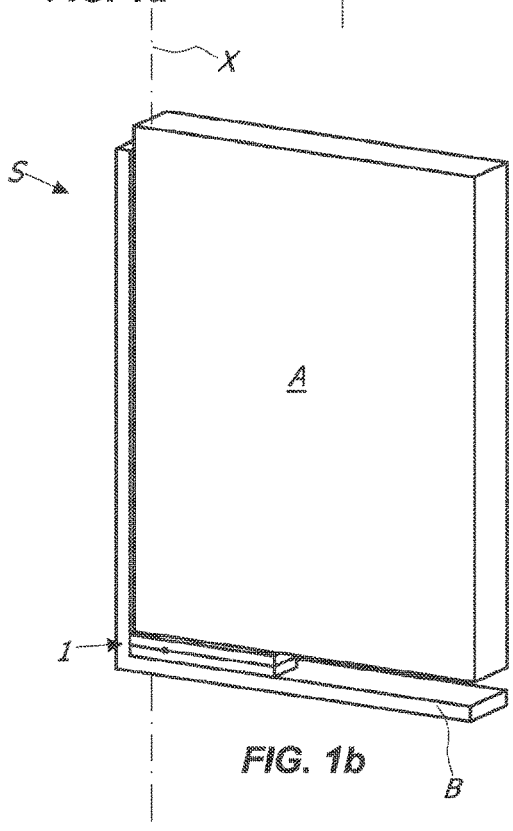
FIGS. 1*b* and 1*c* are axonometric views of an exemplary embodiment of the hinge 1 coupled to a cold room including a stationary support structure S and a shutter A, in which the latter is respectively in the closed and the open position.
Figure 1C:
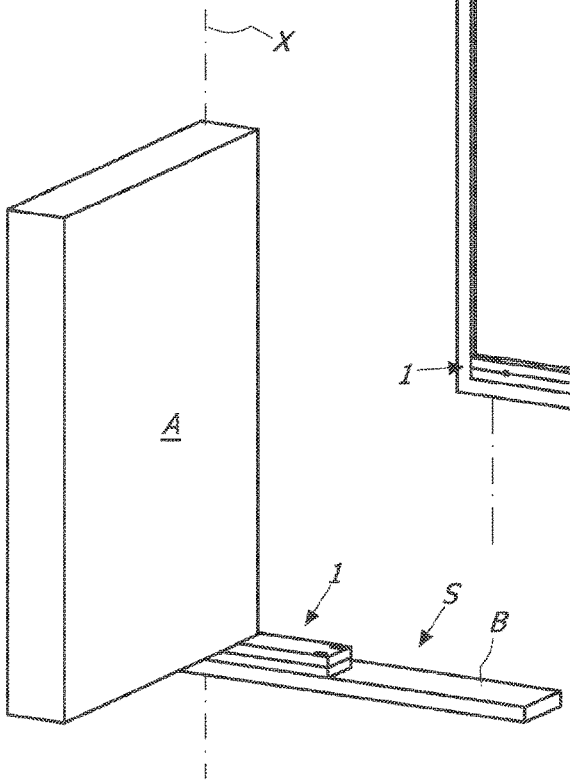
Figure 2:
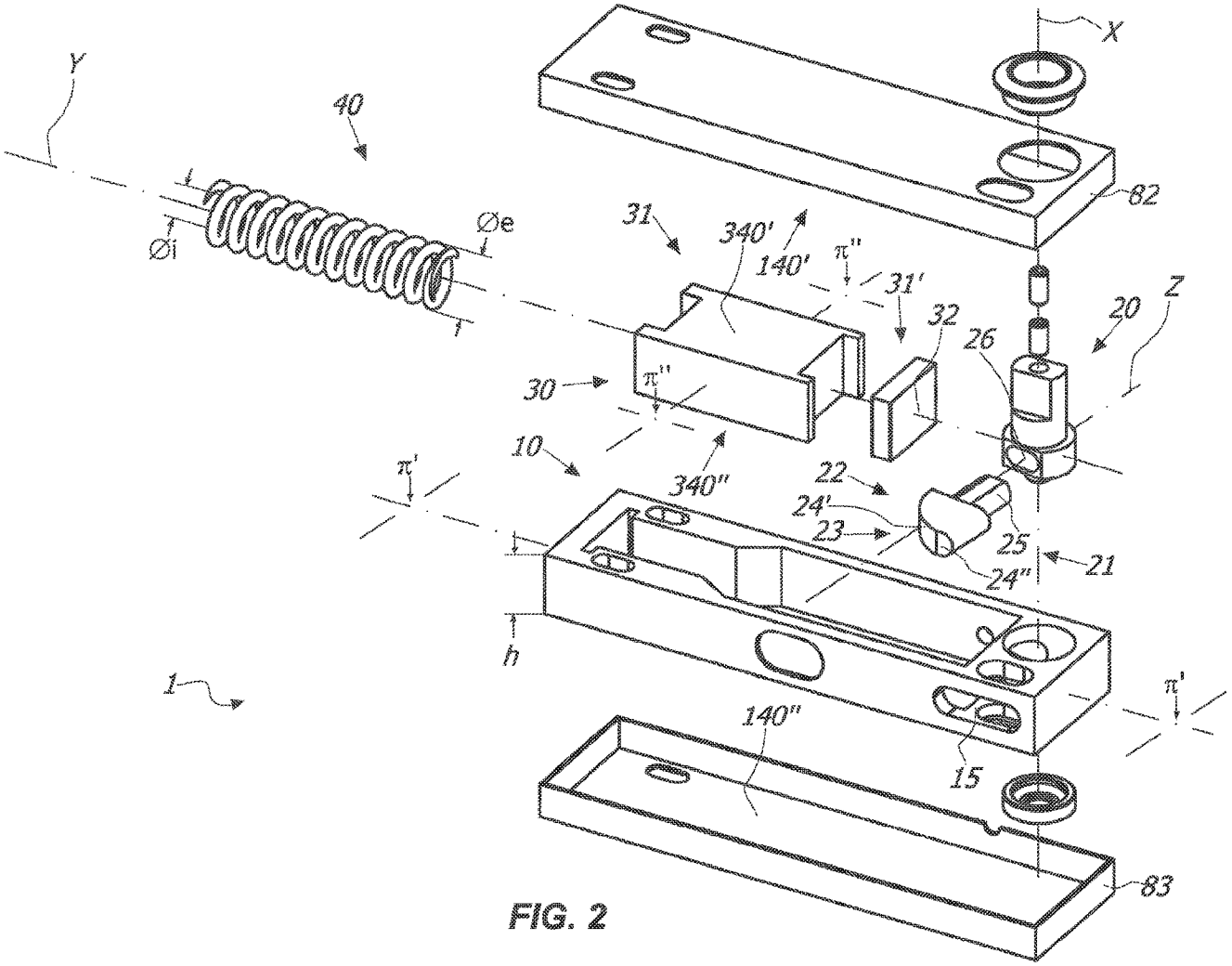
FIG. 2 is an exploded view of a first embodiment of the hinge 1.
Figure 3A:
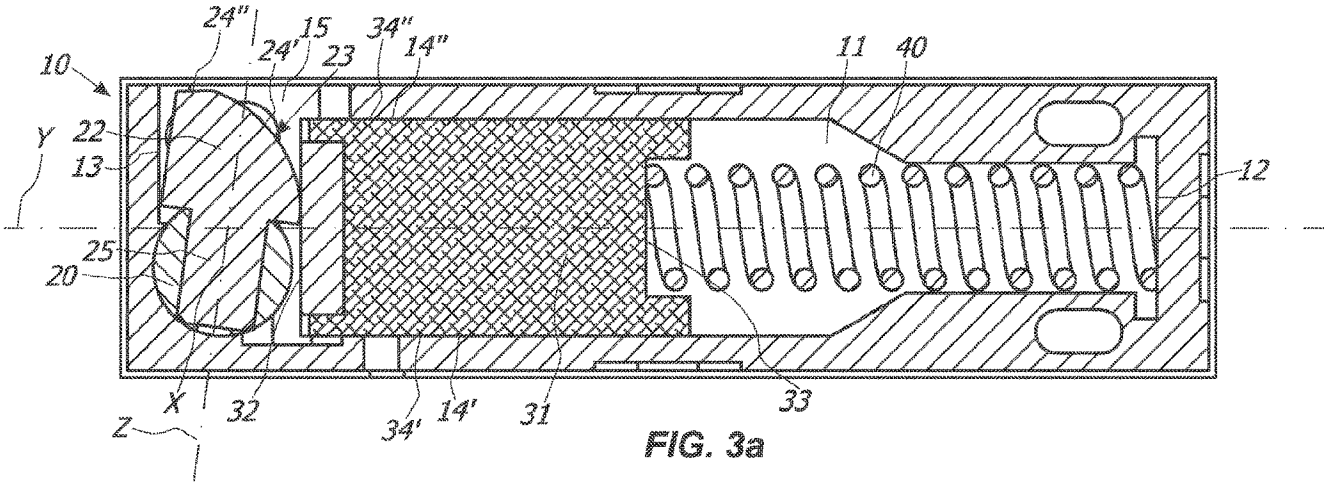
FIGS. 3*a* and 3*b* are views of the first embodiment of the hinge 1 of FIG. 2 sectioned along a plane π-π shown in FIG. 1, the slider 31 being respectively in the distal and proximal position.
Figure 3B:
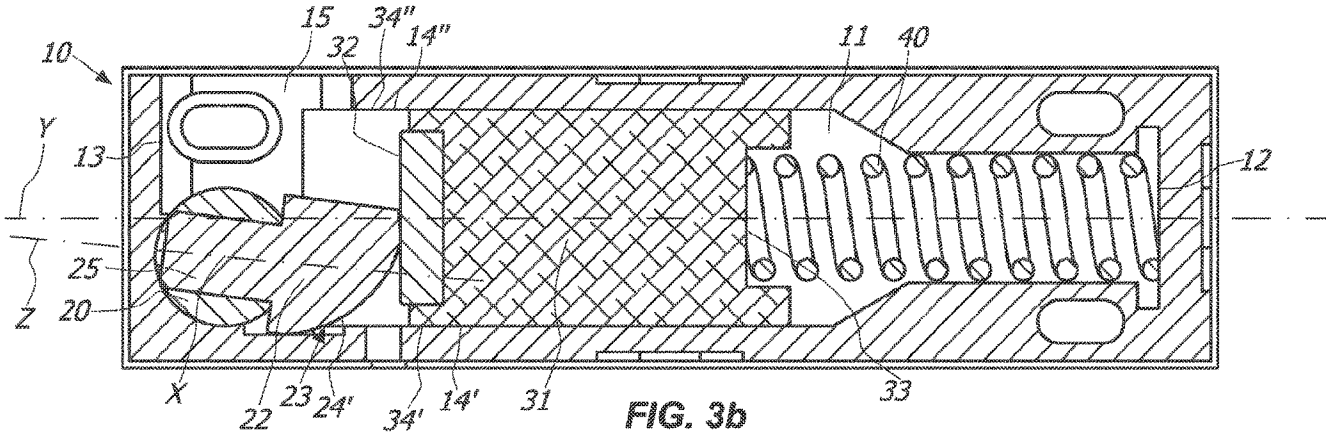
Figure 4:
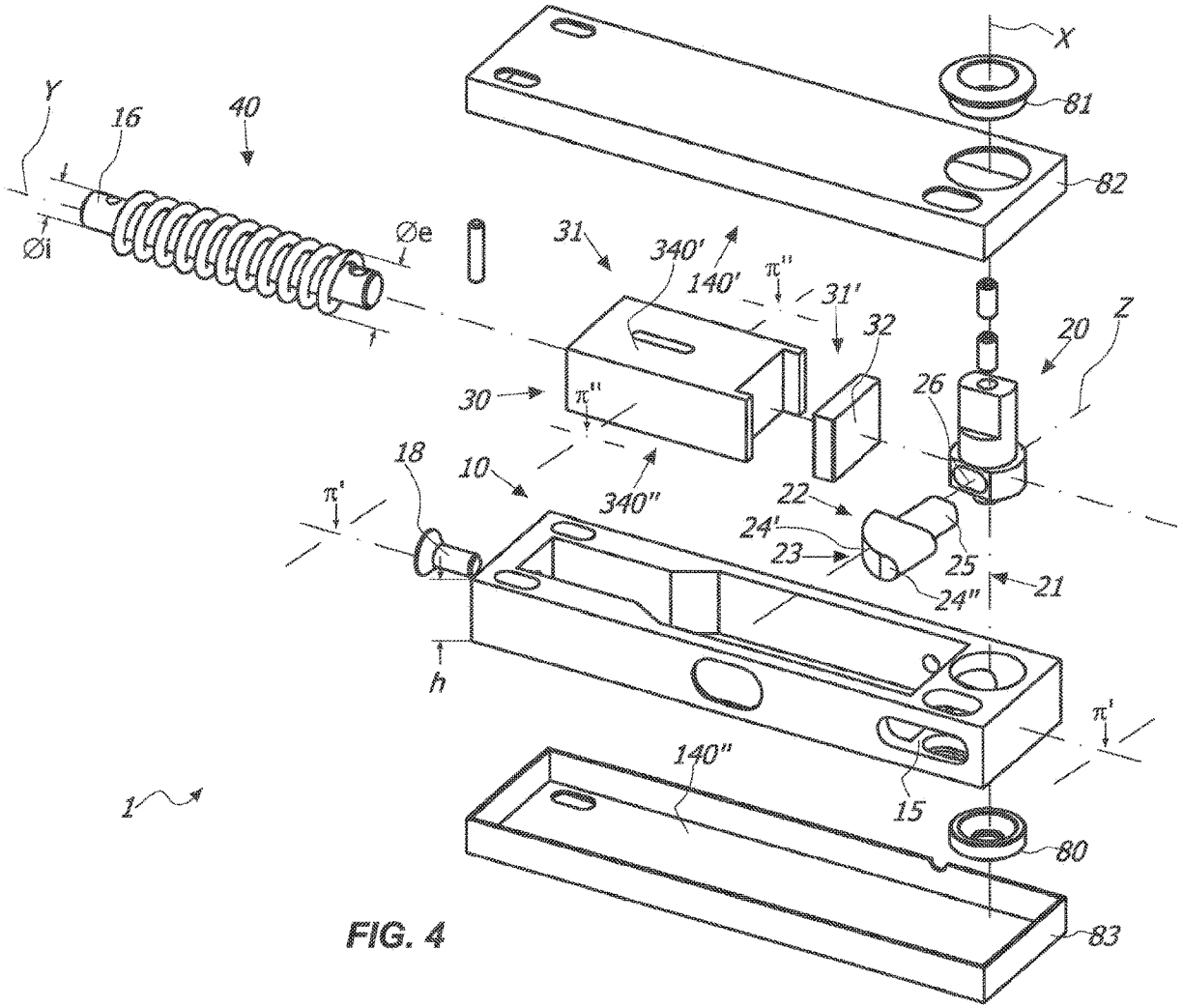
FIG. 4 is an exploded view of a second embodiment of the hinge 1.
Figure 5A:
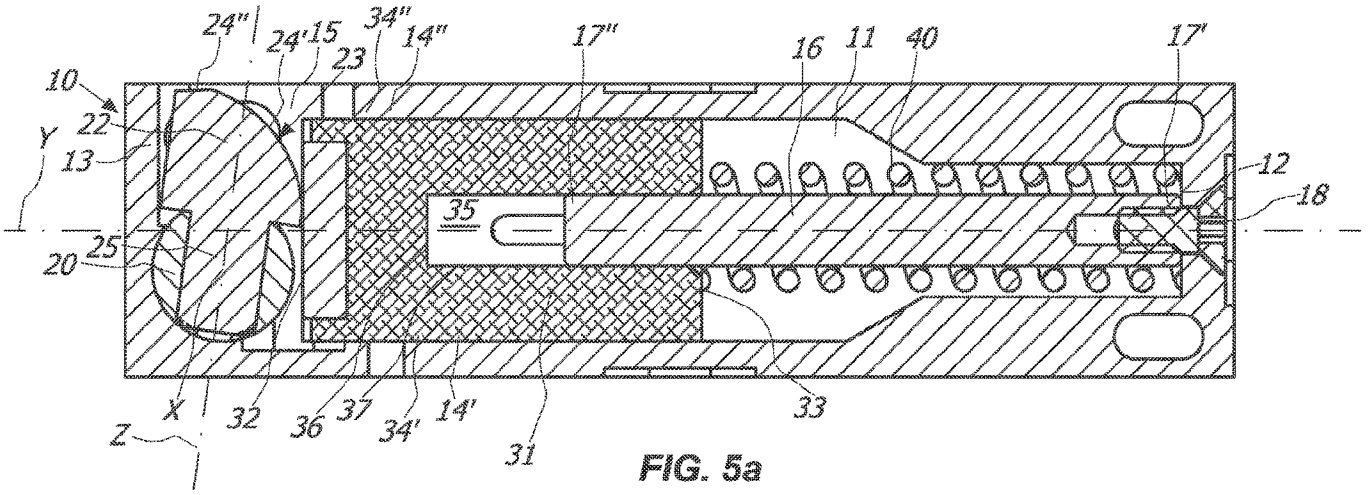
FIGS. 5*a* and 5*b* are views of the second embodiment of the hinge 1 of FIG. 4 sectioned along a plane π-π shown in FIG. 1, the slider 31 being respectively in the distal and proximal position.
Figure 5B:
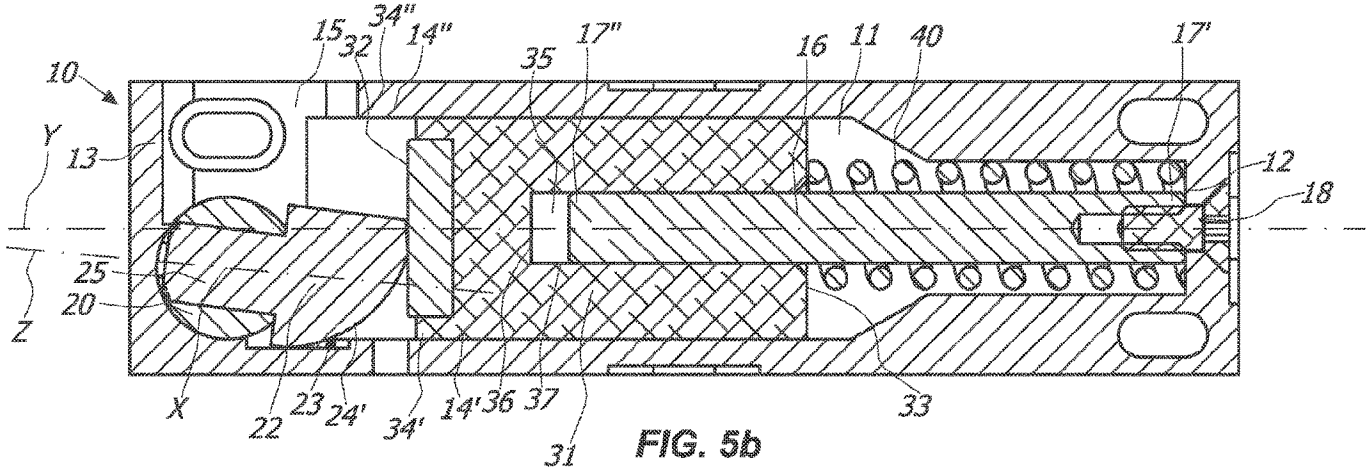
Figure 6:
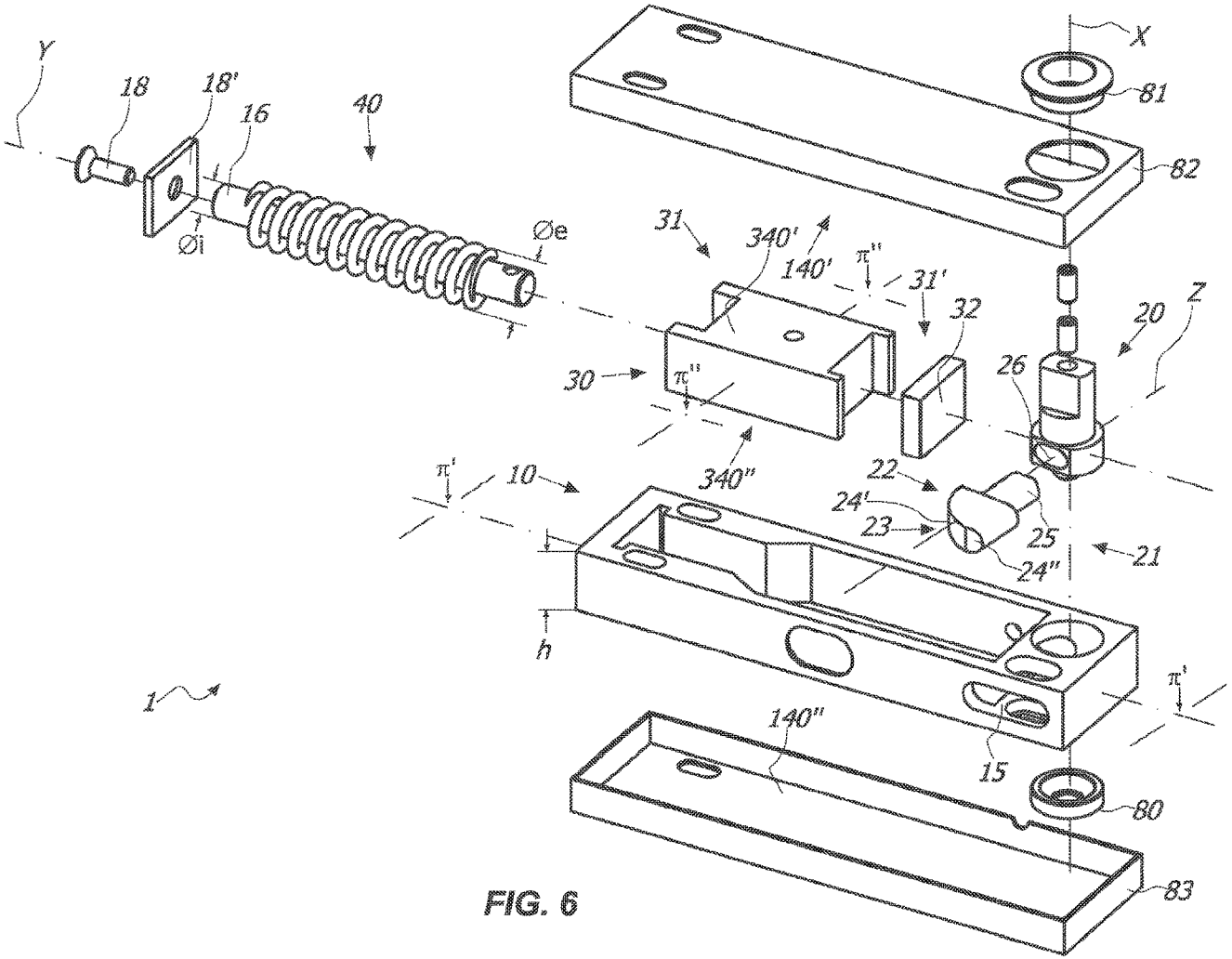
FIG. 6 is an exploded view of a third embodiment of the hinge 1.
Figure 7A:
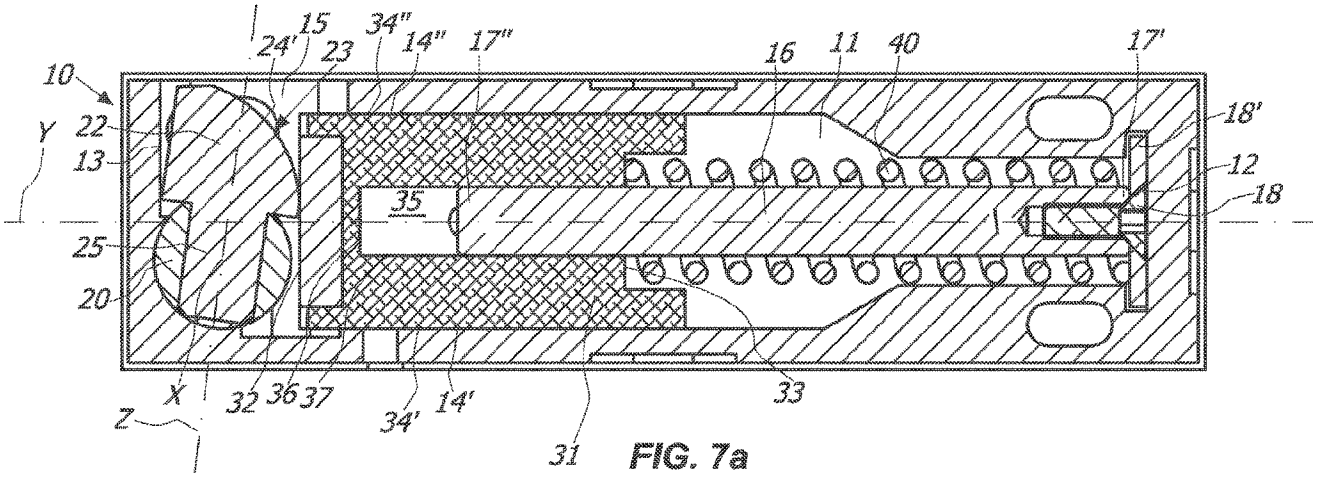
FIGS. 7*a* and 7*b* are views of the third embodiment of the hinge 1 shown in FIG. 6 sectioned along a plane π-π shown in FIG. 1, the slider 31 being respectively in the distal and proximal position.
Figure 7B:
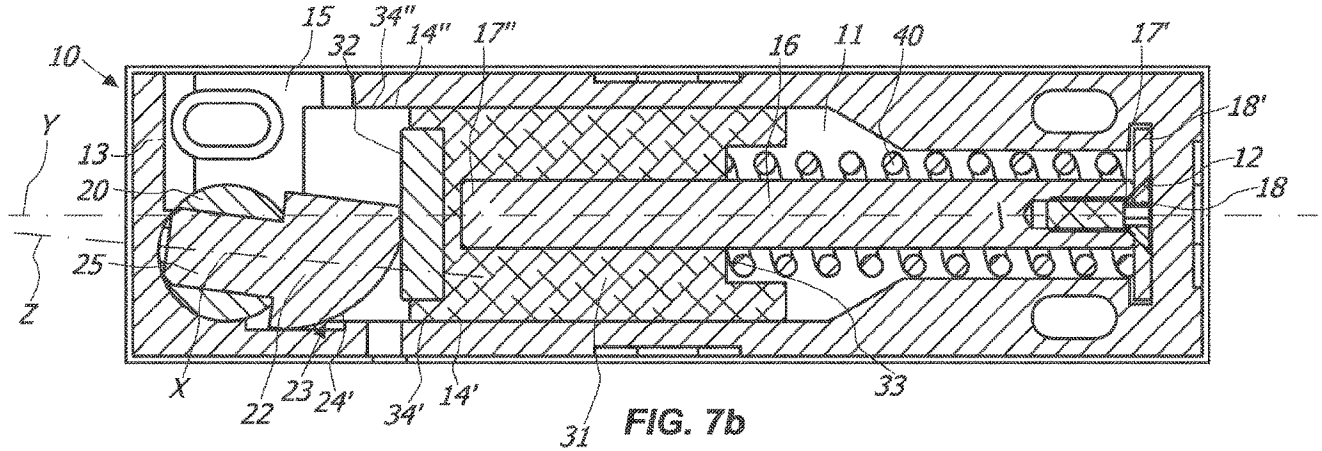
Figure 8:
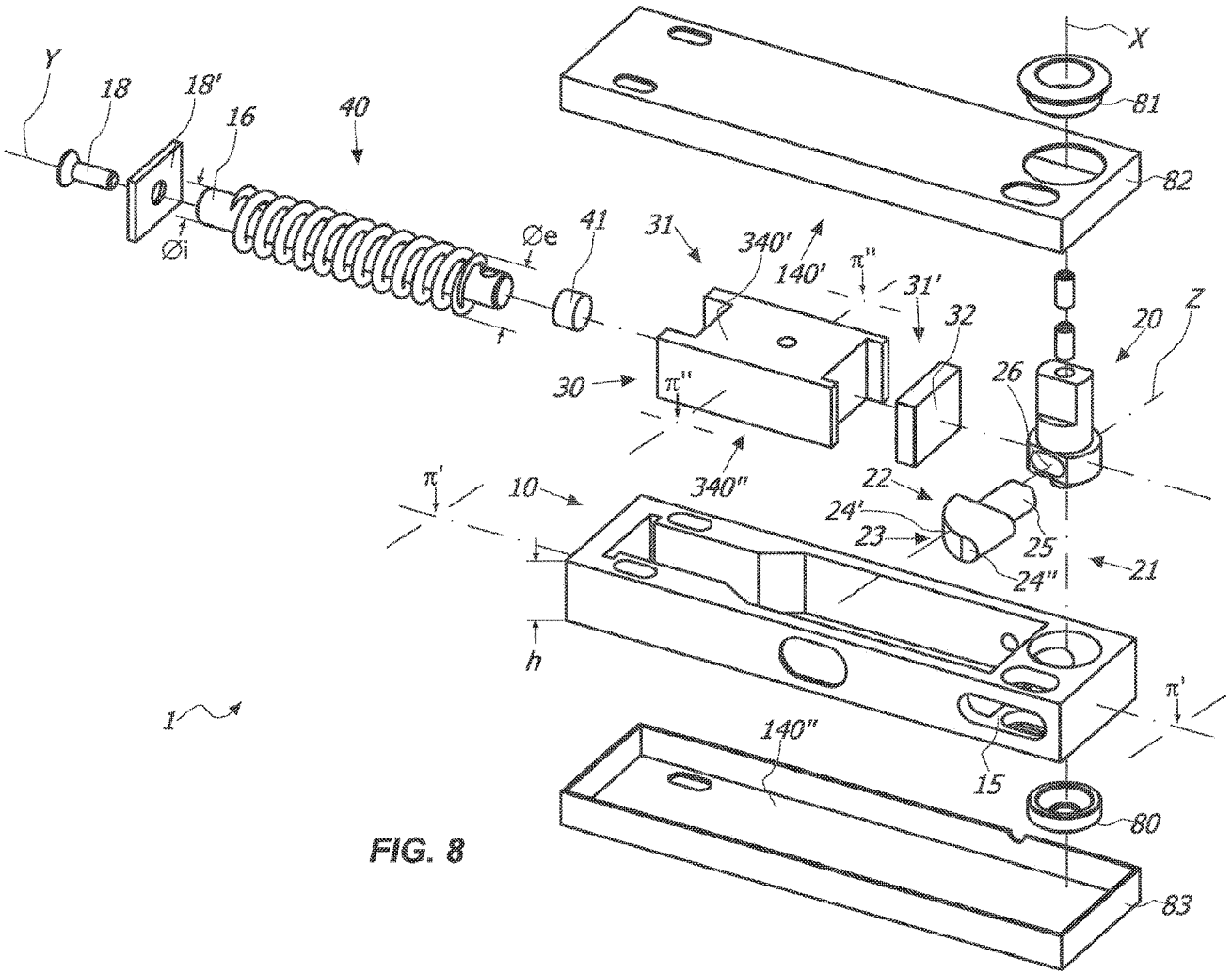
FIG. 8 is an exploded view of a fourth embodiment of the hinge 1.
Figure 9A:
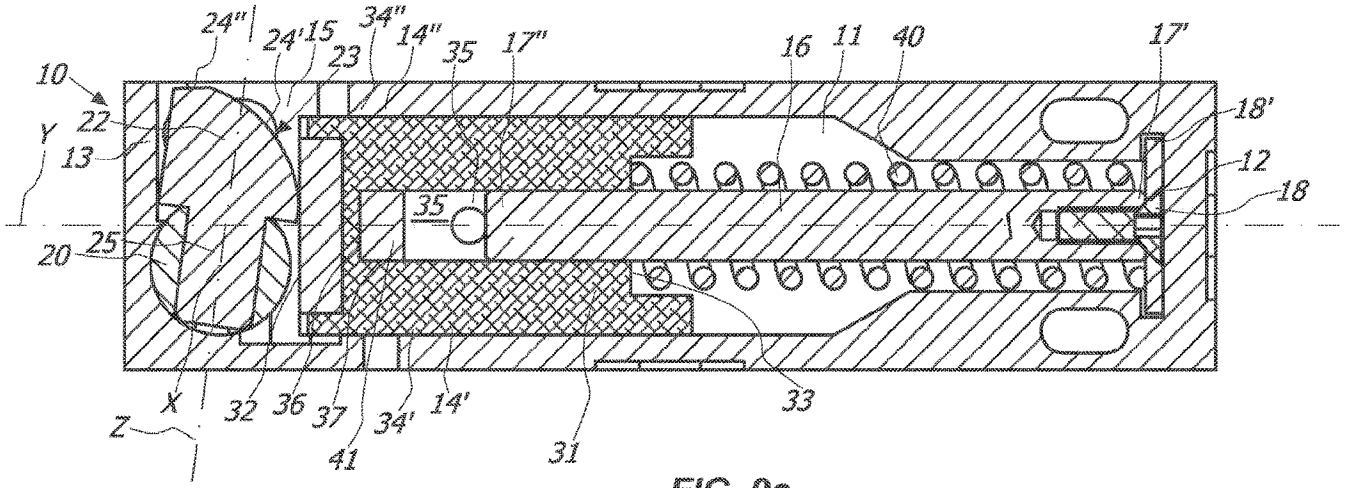
FIGS. 9*a* and 9*b* are views of the fourth embodiment of the hinge 1 of FIG. 8 sectioned along a plane π-π shown in FIG. 1, the slider 31 being respectively in the distal and proximal position.
Figure 9B:
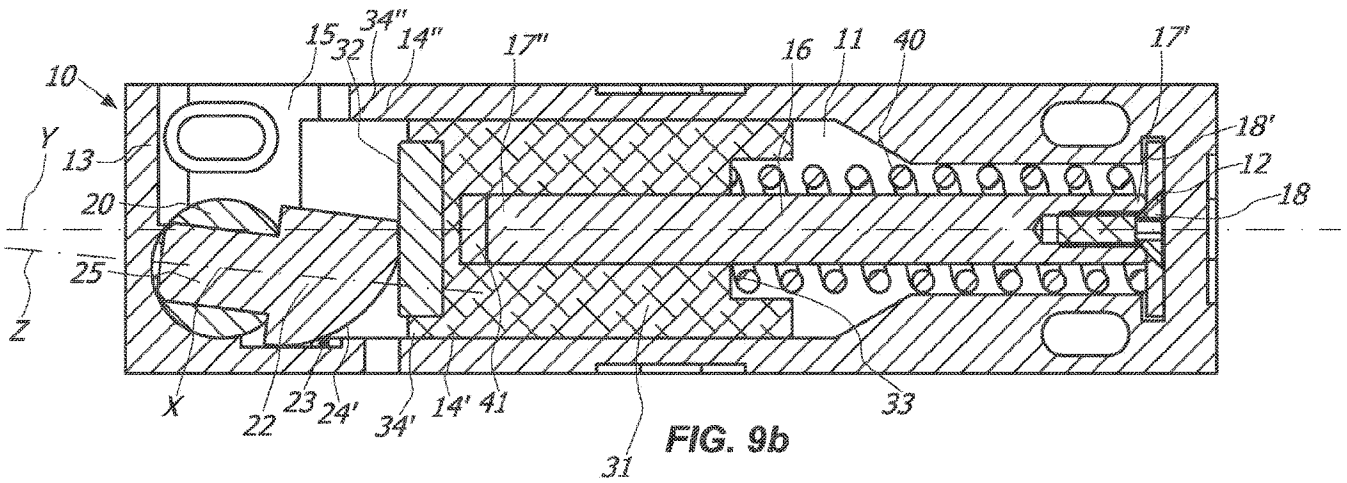
Figure 10:
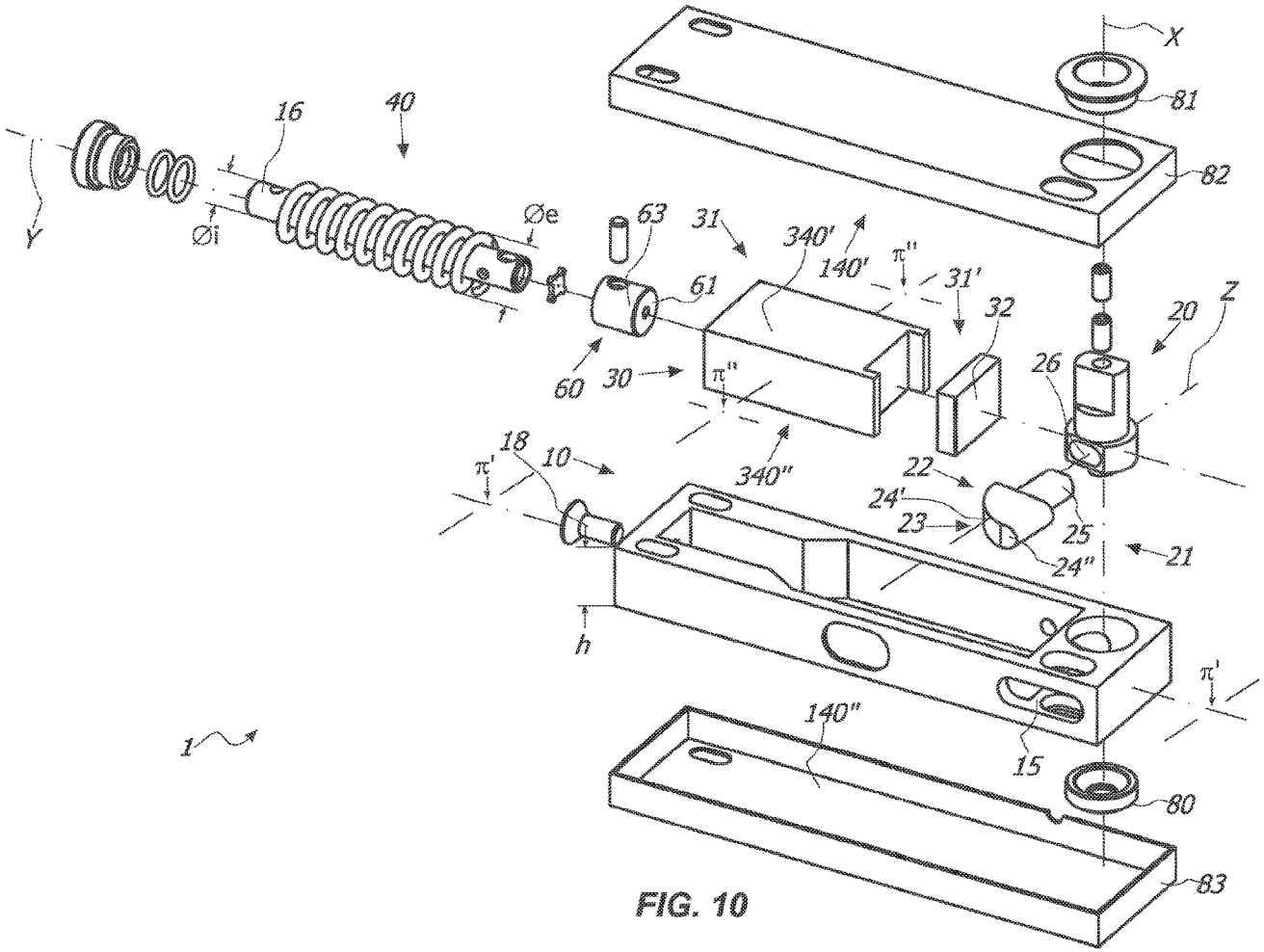
FIG. 10 is an exploded view of a fifth embodiment of the hinge 1.
Figure 11A:
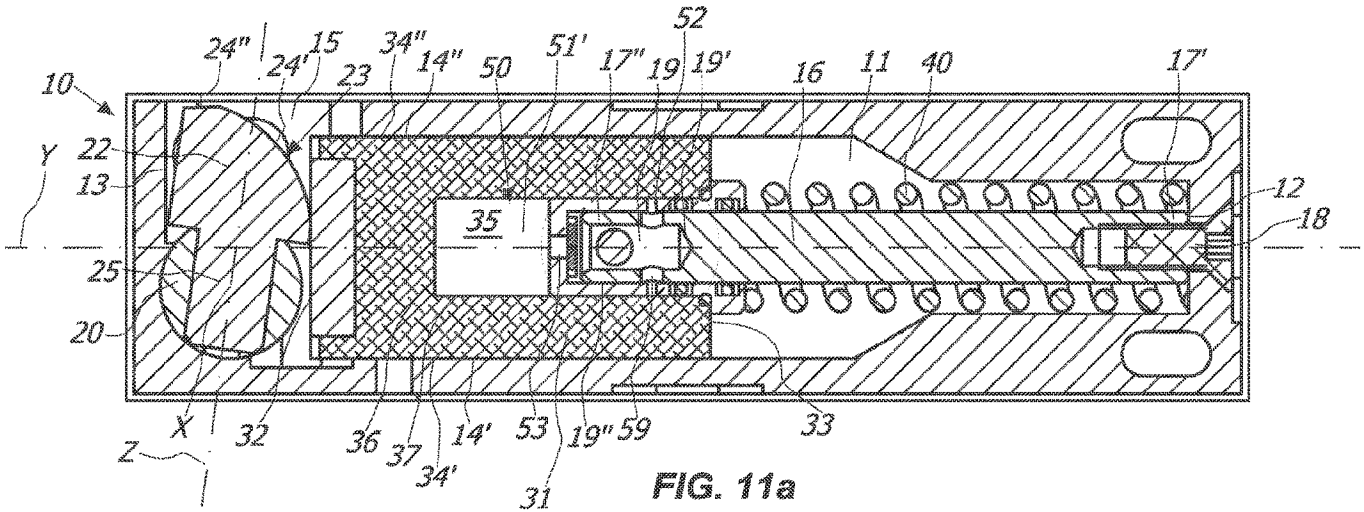
FIGS. 11*a* and 11*b* are views of the fifth embodiment of the hinge 1 of FIG. 10 sectioned along a plane π-π shown in FIG. 1, the slider 31 being respectively in the distal and proximal position.
Figure 11B:
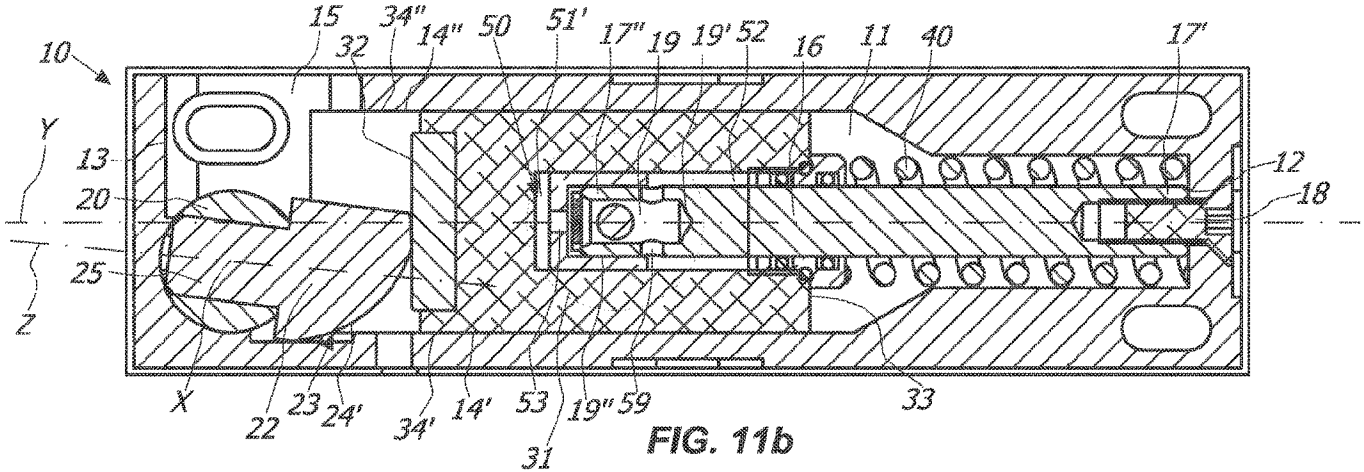
Figure 12A:
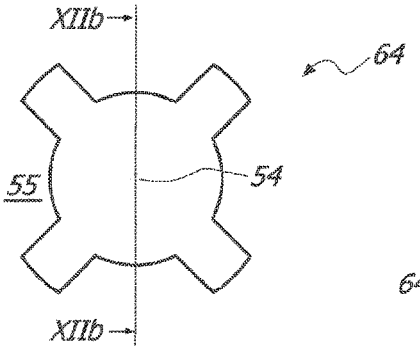
FIGS. 12*a* and 12*b* are respectively a front view and a view sectioned along a plane XIIb-XIIb of the obstructing element 64 of the fifth embodiment of hinge 1 of FIG. 1.
Figure 12B:
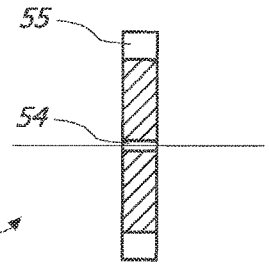

In general, hinge 1 is susceptible to rotatably couple a stationary support structure, such as a tubular frame S, and a shutter A, rotatably movable between an open position, shown as an example in FIG. 1*c,* and a closed position, shown in FIG. 1*b,* about a rotation axis X.

The hinge 1, that may include a movable element and a fixed element rotatably coupled with each other to rotate around the rotation axis X, may be for instance interposed between the frame S and the shutter A, as shown in FIGS. 1*b* and 1*c*.

Suitably, the hinge 1 may include a hinge body 10 with a substantially plate-like shape defining a plane π' and a pivot 20 defining the rotation axis X.

In a first embodiment, the hinge body 10 may be anchored to the base B of the frame S, while the pivot 20 may be anchored to the shutter A. In such a case, the fixed element includes the hinge body 10, while the movable element may include the pivot 20.

Conversely, the hinge body 10 may be anchored to the shutter A and the pivot 20 may be anchored to the frame S. In such a case, the fixed element includes the pivot 20, while the movable element includes the hinge body 10.

Advantageously, the hinge body 10 and the pivot 20 may be reciprocally coupled with each other to rotate around the axis X between the open and the closed positions of the shutter A.

Suitably, the pivot 20 may include a cam element 21 unitary thereto interacting with a plunger element 30 sliding along an axis Y.

Figures 20A, 20B, 20C:
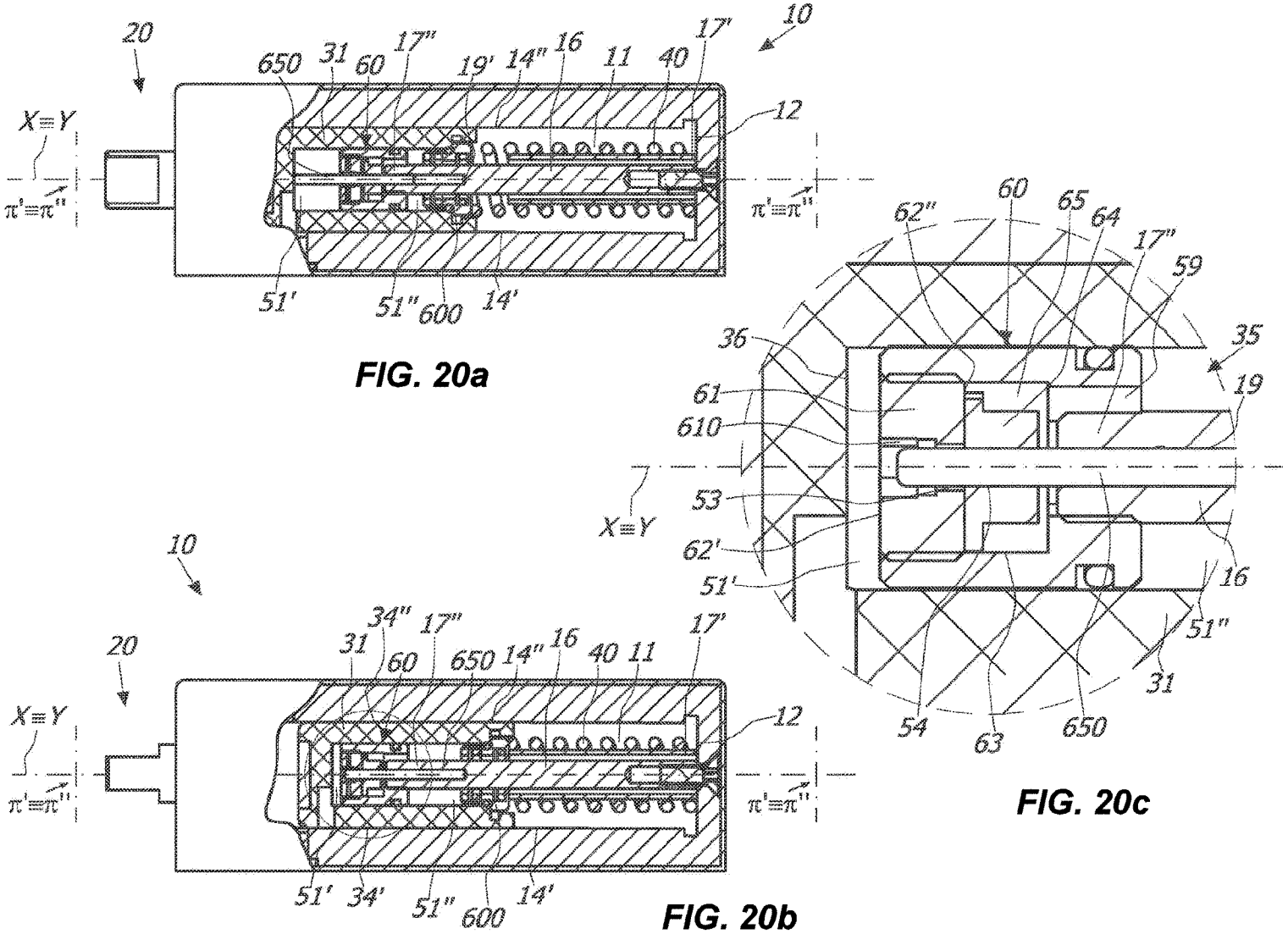
FIGS. 20*a* and 20*b* are partially sectioned views of a further embodiment of the hinge 1 including the assembly of FIG. 18, the slider 31 being respectively in the distal and proximal position, FIG. 20*c* showing some enlarged details thereof.

According to the configuration of the hinge 1, the sliding axis Y of the plunger element 30 may be substantially perpendicular to the axis X, for instance as shown in FIGS. from 1*a* to 19*b,* or it may be substantially parallel or coincident thereto, as shown in FIGS. 20*a* and 20*b*.

Figure 19A:
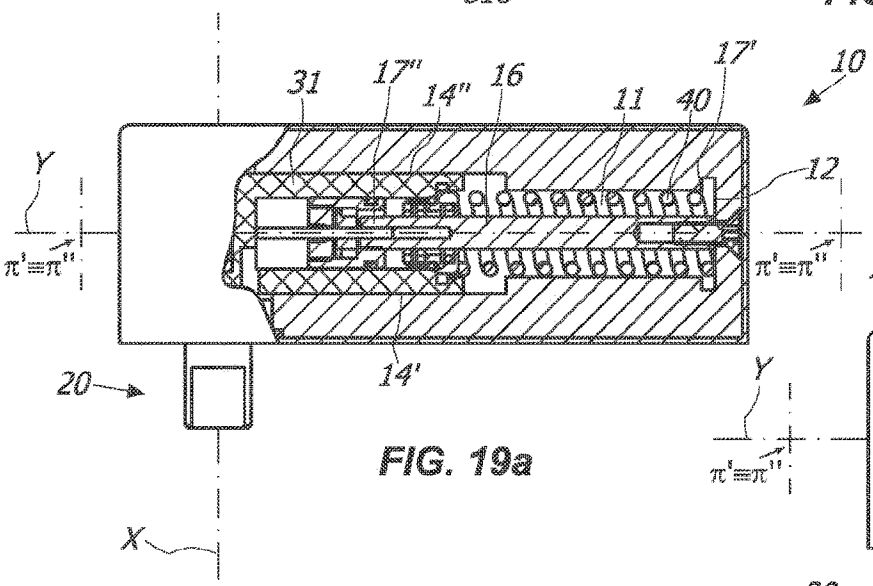
FIGS. 19*a* and 19*b* are partial sectioned views of a further embodiment of the hinge 1 which includes the assembly of FIG. 18, the slider 31 being respectively in the distal and proximal position.
Figure 19B:
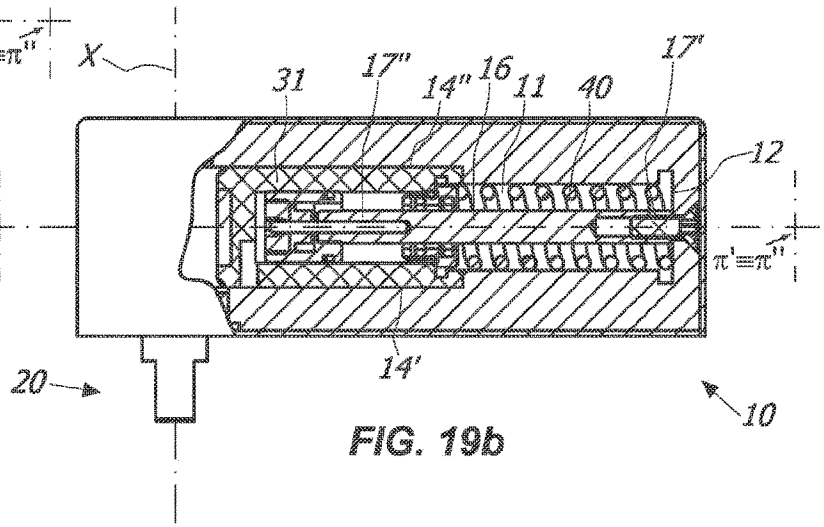

According to the configuration of the hinge 1 the rotation axis X of the shutter A may be substantially perpendicular to plane π' defined by the hinge body 10, for instance as shown in FIGS. from 1 to 17*g,* or substantially parallel to the same plane π' or adjacent thereto, as shown in FIGS. 19*a* and 19*b*.

In any case, the plunger element 30, that may include, respectively may consist of, a slider 31, may slide in a working chamber 11 internal to the hinge body 10 between a retracted end-stroke position proximal to the bottom wall 12 of the working chamber 11, shown for example in FIGS. 3*b*, 5*b*, 7*b*, 9*b*, 11*b*, 16*b*, 19*b* and 20*b*, and an extended end-stroke position distal thereto, shown as an example in FIGS. 3*a*, 5*a*, 7*a*, 9*a*, 11*a*, 16*a*, 19*a* and 20*a*.

Suitably, such retracted and extended end-stroke positions may be whichever, and therefore these positions don't necessarily correspond to the maximum distal and/or proximal positions of the plunger element 20.

In a preferred but not exclusive embodiment of the invention, the working chamber 11 may include counteracting elastic means acting on the slider 31 to move it between the proximal and the distal positions.

In a preferred but not exclusive embodiment of the invention, the counteracting elastic means may include, respectively may consist of, a coil spring 40 with a predetermined diameter.

According to the configuration, the counteracting elastic means 40 may be thrusting or restoring elastic means.

In the case of thrusting counteracting elastic means, their force will be such to automatically return the shutter A from the open or the closed position reached when the slider 31 is in the proximal position to the other of the open or closed position reached when the slider 31 is in the distal position.

In this case, whether if the position achieved by the shutter A when the slider 31 is in proximal position is the open or the closed position, the hinge 1 is an opening hinge or a closing hinge, the latter being also called door closing hinge.

On the other side, in case of restoring counteracting elastic means, their force will not be able to return the shutter A from the open or closed position reached when the slider 31 is in the proximal position to the other of the open or closed position reached when the slider 31 is in the distal position. In such a case, the shutter A has to be moved manually or anyway by with actuator means which do not belong to the hinge 1, for instance a small motor.

However, the force of the restoring counteracting elastic means is such to bring back the slider 31 from the proximal position to the distal one.

In this case, whether if the position reached by the shutter A when the slider 31 is in proximal position is the open or the closed one, the hinge 1 is an opening or closing check hinge.

Apparently, the closing or opening hinge also acts as a opening or closing check hinge, while the opposite is not true.

It is understood that even if in the attached figures a closing hinge is shown, the same hinge may be a closing hinge or an opening hinge, as well as a check opening or closing hinge without exceeding the scope of protection defined by the appended claims.

Advantageously, the slider 31 may be substantially plate-like to define a plane π" substantially coincident with plane π" defined by the hinge body 10.

Suitably, the slider 31 may be guided by the walls of the working camber 11 during its sliding along the axis Y.

Preferably, the slider 31 may have a substantially parallelepiped shape with an operative face 32 faced to the front wall 13 of the working chamber 11, the bottom face 33 faced to the bottom wall 12 of the working chamber 11 and side walls 34', 34" faced and preferably in contact engage with the side walls 14', 14" of the same chamber 11. In this manner, the latter acts as guiding means for the slider 31.

Preferably, the working chamber 11 may further have a pair of faced shaped walls 140', 140" interacting with a respective pair of opposite countershaped walls 340', 340" of the slider 31. Suitably, the faced walls 140', 140" may be defined by the internal face of the protective cover of the hinge 1, for instance by protective carters 82, 83.

Preferably, the faced shaped walls 140', 140" may have a plate-like shape, as well as the opposite walls 340', 340", and may preferably be in contact engage with the latter so as to guide them during the sliding of the slider 31 along the axis Y.

In a preferred but not exclusive embodiment, the walls 14', 14" and 34', 34" may be substantially parallel to each other, as well as the walls 140', 140" and 340', 340". Preferably, the walls 14', 14" and 34', 34" may further be substantially perpendicular to the plane π' defined by the hinge body 10, while the walls 140', 140" and 340', 340" may be substantially parallel to the plane π' defined by the hinge body 10.

In a preferred but not exclusive embodiment, the cam element 21 may include an elongated appendix 22 extending outwardly from the pivot 20 in a substantially transversal direction with respect to the axis X so that its working face 23 comes in contact engage with the operative face 32 of the slider 31, so as to reciprocally interact.

In a preferred but not exclusive embodiment, the working face 23 may have a first portion 24' having a substantially concentric curvilinear shape with respect to the axis X and a second portion 24" consecutive to the first one having a substantially plate-like shape which is substantially parallel to the axis X. Suitably, the operative face 32 of the slider 31 may furthermore have a substantially plate-like shape substantially parallel to the axis X.

Such embodiment is particularly advantageous both in reliability over time and in the safety of the hinge 1.

Advantageously, the portion 24' having substantially curvilinear shape may indeed be configured to come in contact engage with the operative face 32 of the slider 31 in a contact point CP substantially central thereto.

Particularly, the contact point CP may have a minimum distance d from a median plane πM substantially perpendicular to the plane π during all the rotation of the shutter A between the open and closed position. On the other hand, in case the axis Y lies on the median plane πM, for instance as shown in the attached figures, the distance d may be interpreted as the distance between the point CP and the axis Y.

Practically, the first portion 24' of the working face 23 and the operative face 32 of the slider 31 may be reciprocally configured so as the latter is tangent to the curve defining the portion 24' in the point CP.

Suitably, the distance d may be comprised between 0.4 mm and 4 mm. More preferably, the distance d may be increasing and comprised between 1 mm and 4 mm for a shutter A opening or closing angle α of 0° to 60°, while it may be decreasing for an angle α greater than 60°, in particular of 60° to 90°. The distance d may be minimal in correspondence to the opening or closing rest position of the shutter A.

Figure 17A:
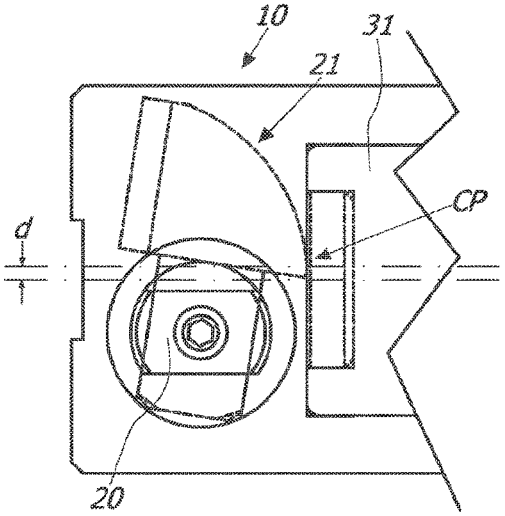
FIGS. 17*a* to 17*g* are schematic views of some positions that the cam element 21 assumes during its rotation around the axis X.
Figure 17B:
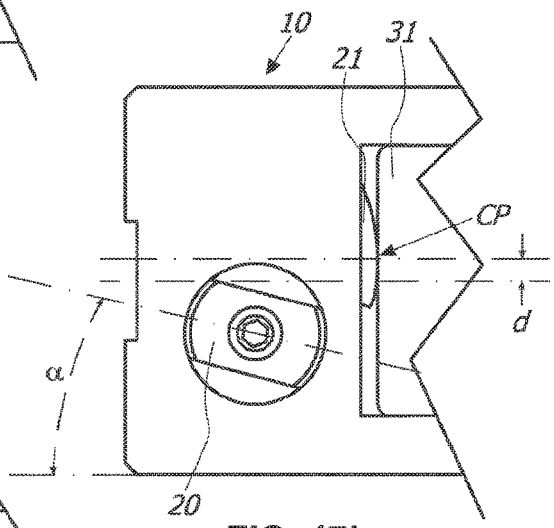
Figure 17C:
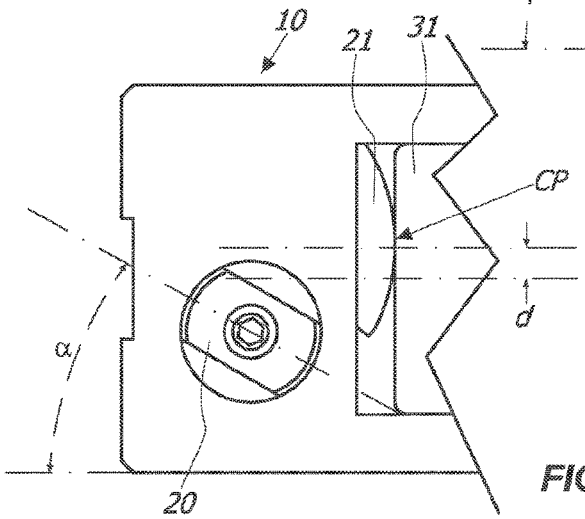
Figure 17D:
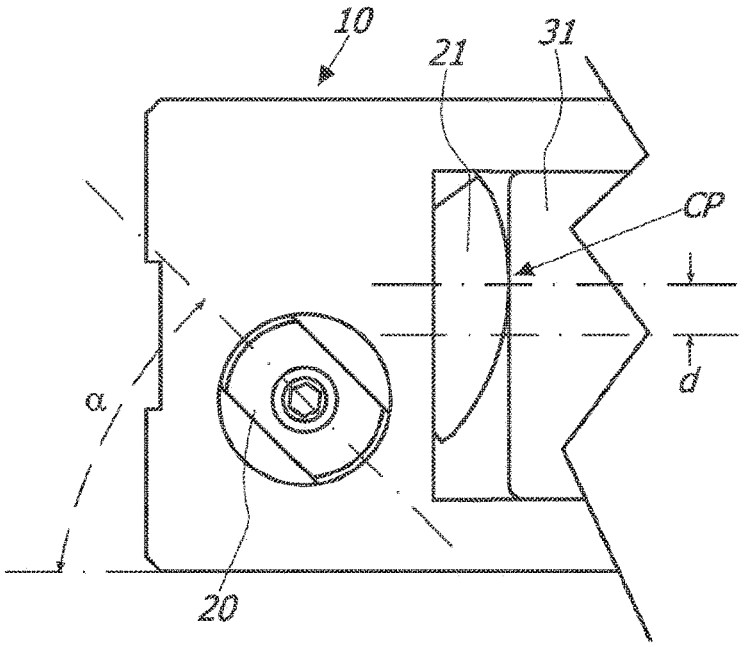
Figure 17E:
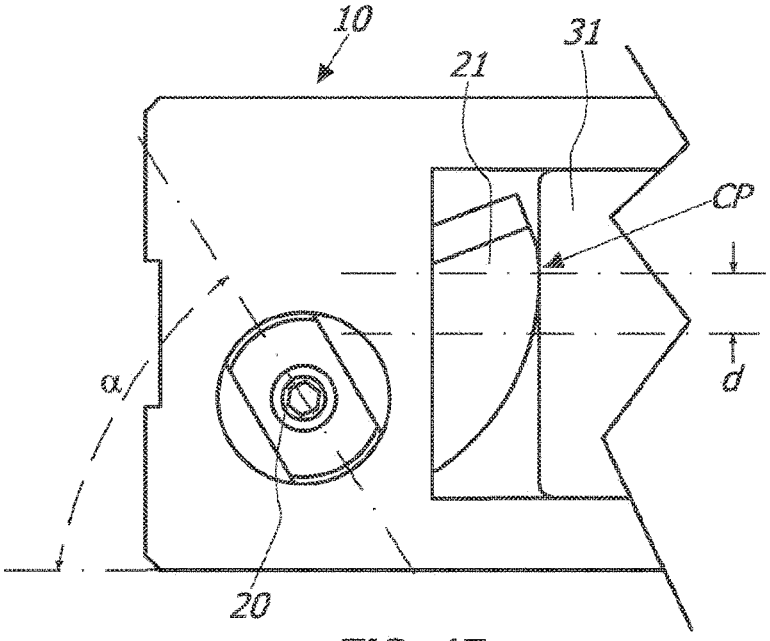
Figure 17F:
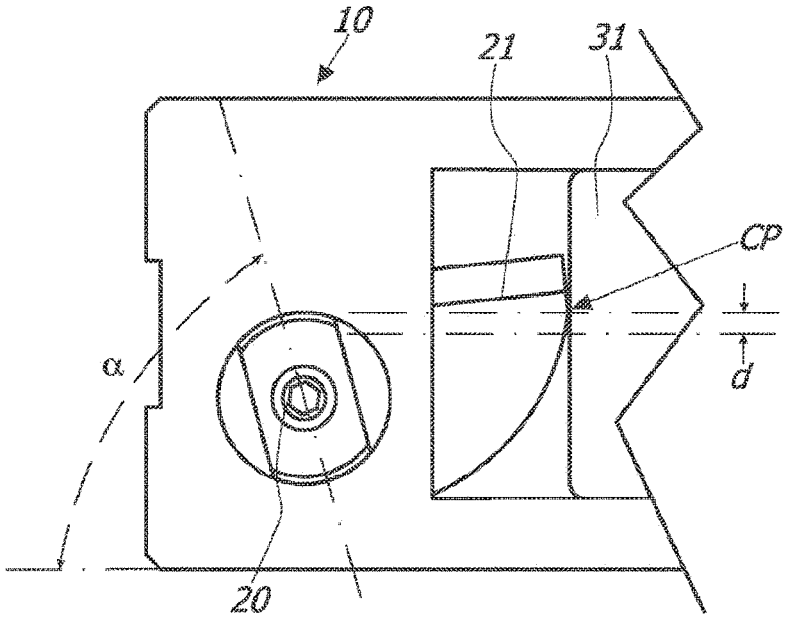
Figure 17G:
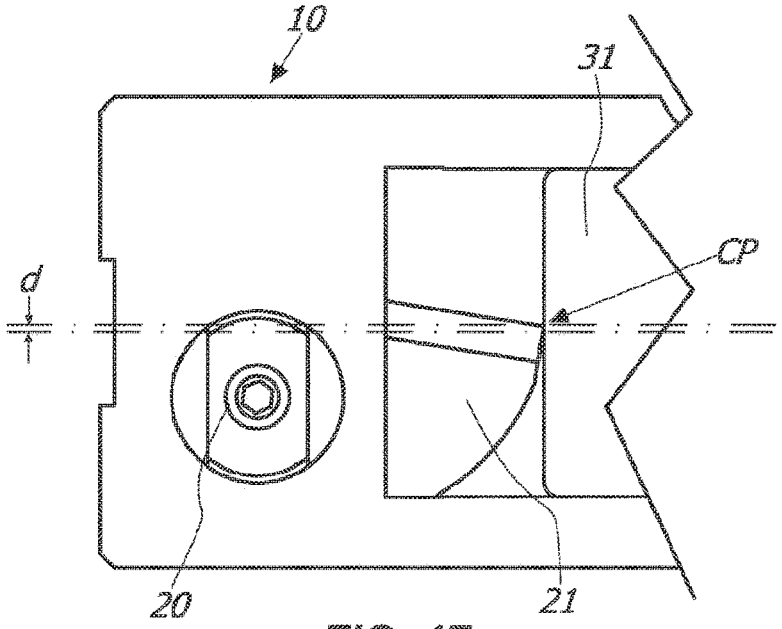
Figure 18:
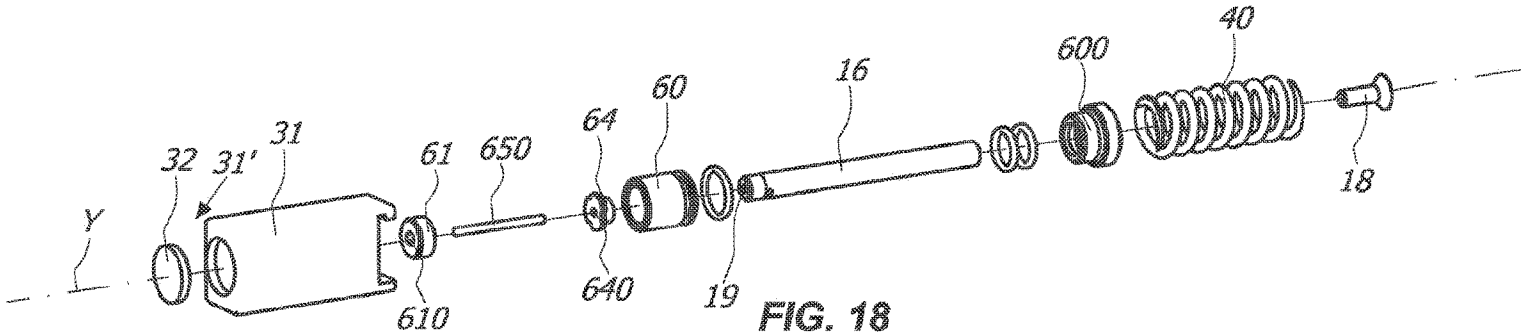
FIG. 18 is an exploded view of a further embodiment of the assembly plunger element 30—hydraulic damping means—counteracting elastic means 40.

In FIGS. 17*a* to 17*g* the distances d are shown between the point CP and the axis Y, that is from the point CP and the median plane πM for angles α comprised between 0° (FIGS. 17*a*) and 90° (FIG. 17*g*).

In particular, when the angle α is of 0° (FIG. 17*a*) the distance d is of 1.1 mm; when the angle α is of 15° (FIG. 17*b*) the distance d is of 1.7 mm; when the angle α is of 30° (FIG. 17*c*) the distance d is of 2.9 mm; when the angle α is of 30° (FIG. 17*c*) the distance d is of 2.9 mm; when the angle α is of 45° (FIG. 17*d*) the distance d is of 3.6 mm; when the angle α is of 60° (FIG. 17*e*) the distance d is of 3.8 mm; when the angle α is of 75° (FIG. 17*f*) the distance d is of 3.4 mm; when the angle α is of 90° (FIG. 17*g*) the distanced is of 0.4 mm.

This ensures that the interaction between the cam element 21 and the plunger element 30 always occurs in a substantially central position, so as to maximize the performance of the counteracting elastic means 40, to avoid misalignments of the slider 31 and to minimize the side frictions.

On the other hand, the second portion 24" is susceptible to reciprocally engage with the operative face 32 of the slider 31 to maintain the shutter A in the open or closed position, that is basically to define the rest position of the latter.

Advantageously, such reciprocal engagement may occur when the axis Z defined by the elongated appendix 22 which transversally extend from the pivot 20 perpendicularly to the axis X and parallel to the axis Y passes the centre line of the hinge 1 defined by the axis Y.

This ensures the maintenance of the rest position of the shutter A over time, which is also advantageous in terms of safety. The reaction of the counteracting elastic means 40 tends indeed to maintain the rest position even in case of impact with the shutter A, till a rotation sufficient to release the second portion 24" of the working face 23 of the cam element 21 and the operative face 32 of the slider 31.

It is understood that the rotation of the axis Z is relative to the hinge body 11. In other words, in the embodiments in which the pivot 20 is stationary and the hinge body 11 rotates around the axis X, the axis Z rotates with respect to the hinge body 11 and the shutter A, although it is in practice stationary with respect to the stationary support structure S.

In order to low the cost of the hinge, the slider 31 my include an insert 31' to which the operative face 32 belongs. The slider 31 may be made of a first metal material, such as aluminum, while the inset 31' may be made of a second metal material harder than the first one, such as steel. In this manner, only the part actually in contact engage with the cam element 21 is made of a harder and more expensive material, while the remaining part of the slider 31 may be manufactured with a cheaper material.

To ensure the maximal stroke of the slider 31, the pivot 20 may be placed at one of the side walls 14', 14" of the working chamber 11.

In this case, the axis Z rotates around the axis X eccentrically with respect to the median plane πM between a rest position, shown for instance in FIGS. 3*a*, 5*a*, 7*a*, 9*a*, 11*a e* 16*a*, where the slider 31 is in the distal position and a working position, shown for instance in FIGS. 3*b*, 5*b*, 7*b*, 9*b*, 11*b e* 16*b*, where the slider 31 is in the proximal position.

In this case, the suitable dimensioning of the cam element 21 provides for imparting the maxim stroke to the slider 31, which is advantageous in terms of precompression force of the counteracting elastic means 40.

In a preferred but not exclusive embodiment, the cam element 21 may be removably insertable in the pivot 20 through an opening 15 passing through the hinge body 10, the passing-through opening being preferably made at the side wall 14' opposite to the one 14" where the pivot 20 is placed.

In this case, a user may access the pivot 20 through the passing-through opening 15 to insert the cam element 21, which is advantageous in terms of speed and easy to assembling the hinge 1.

To this end, the cam element 21 may include a pin 25 extending outwardly from the elongated appendix 22 to define the transversal axis Z. The pin 25 may be removably insertable in a countershaped seat 26 of the pivot 20. To minimize the vertical dimensions, the pin 25 may have a substantially oval section.

Suitably, the passing-through opening 15 and the cam element 21 may be reciprocally configured so that the former houses at least one portion of the latter when the third axis Z is in the rest position. This maximizes the precompression force of the counteracting elastic means 40, thus minimizing the horizontal bulkiness.

In a preferred but not exclusive embodiment, the working chamber 11 may include a rod 16 defining the axis Y. In this case, the counteracting elastic means may include, or may consist of, a coil spring 40 fitted over the rod 16, the latter acting as guide for the former.

Possibly, the spring 40 may be guided by the side walls of the working chamber 11 during its sliding along the axis Y, with or without the guiding rod 16.

Preferably, the counteracting elastic means may consist of a single coil spring 40, that may be a thrust or restore spring. In other words, the coil spring 40, may be the only counteracting means of the hinge.

As soon as the coil spring 40 is fitted over the rod 16, the spring 40 remains interposed between the bottom wall 12 of the chamber 11 and the bottom face 22 of the slider 31, the latter acting as abutment face for the same spring 40.

The hinge 1 may have very low vertical and horizontal bulkiness. The spring 40 may have an outer diameter θe equal to or slightly less than the thickness h of the hinge body 10.

Suitably, this thickness h may be substantially equal to or slightly more than the thickness of the slider 31. Approximately, the thickness h may be less than 30 mm, and preferably less than 25 mm.

Furthermore, the spring 40 may have an internal diameter θi substantially equal to or slightly more than the diameter of the supporting rod 16 on which it is fitted.

Advantageously, the slider 31 may include an axial blind hole 35 susceptible to house the rod 16, so that the former slides along the axis Y with respect to the latter between the distal and the proximal positions.

More particularly, the rod 16 may comprise a first end 17' operatively coupled with the bottom wall 12 of the chamber 11, for instance by screw means 18, and a second end 17" inserted within the axial blind hole 35 to remain faced to the bottom wall 36 of the latter.

Due to such configuration, the hinge 1 is extremely easy and fast to be assembled. In fact, as soon as the spring 40 is fitted over the rod 16 and the latter is inserted within the axial blind hole 35 of the slider 31, it is sufficient to insert the assembly in the working chamber 11, screwing the rod 16 on the bottom wall 12 through the screw means 18 and subsequently inserting the cam element 21 through the opening 15.

In a preferred but not exclusive embodiment, the screw means 18 may be susceptible to be directly screwed to the rod 16 through an abutment plate 18' of the spring 40. This maximally simplifies the assembly of the hinge. In fact, as soon as the spring 40 is fitted over the rod 16, the spring 40 is blocked by the plate 18' and this assembly is inserted in the chamber 11 from the top side thereof.

In any case, to complete the assembly of the hinge 1 it is sufficient to insert on the pivot 20 the bearing 80 and the bushing 81 and assembling on the hinge body 10 the protective covers 82, 83.

In a preferred but not exclusive embodiment, the bottom wall 36 of the axial blind hole 35 may comprise shock-absorbing elastomeric means 41 susceptible to interact with the second end 17" of the rod 16 when the slider 31 is in the proximal position.

On the other hand, the shock-absorbing elastomeric means 41 may be coupled to the second end 17" of the rod 16 to interact with the bottom wall 36 of the axial blind hole 35.

In this way, it is possible to elastically shock-absorb the opening and/or closing movement of the shutter A.

The effect of the elastic shock-absorbing action depends on the type of elastomer material which is used and/or on its chemical-physical characteristics, and particularly on its hardness.

Advantageously, the shock-absorbing elastomeric means 41 may be made of a compacted polyurethane elastomer, for instance Vulkollan®. Suitably, the elastomer may have a hardness Shore A of 50 ShA to 95 ShA, preferably of 70 ShA to 90 ShA. More preferably, the shock-absorbing elastomeric means 41 may have a Shore A hardness of 80 ShA.

The use of the elastomer provides for an efficient shock-absorbing action in a very reduced space. The stroke of the shock-absorbing elastomeric means 41 along the axis Y may in fact be in the order of some millimeters, for instance 2 to 4 mm.

Furthermore, the shock-absorbing elastomeric means 41 provides for a braking effect of great performance in a purely mechanic hinge, without the use of oil or any kind of hydraulic damping means. However, the shock-absorbing elastomeric means 41 may be used in cooperation with the hydraulic damping means without exceeding the scope of protection defined by the appended claims.

In a preferred but not exclusive embodiment, the hinge body 10 may comprise a stationary element susceptible to act as an abutment for the slider 31 in the proximal position.

Suitably, the stationary element may be defined by the portions 110', 110" of the hinge body 10.

In light of the above disclosure, the hinge 1 may be of mechanic type, as for instance shown in FIGS. 2 to 9*b*, or it may include hydraulic damping means, as for instance shown in FIGS. 10 to 20*c*, which hydraulic damping means acting upon the plunger element 31 to hydraulically damp the sliding thereof along the axis Y.

On the other side, the mechanic hinge 1 may include the rod 16, as for instance shown in FIGS. from 4 to 16*b*, or not, as for instance shown in FIGS. from 2 to 3*b*.

Suitably, the hydraulic damping means may include, respectively may consist of, a working fluid, for instance oil, entirely contained in a hydraulic circuit 50 internal to the slider 31. To this end, the hydraulic circuit 50 may include the blind hole 35.

This maximally simplifies the structure of the hinge 1, thus minimizing the costs thereof. All the hydraulic system of the hinge is in fact contained within the slider 31, the remaining parts remaining dry and therefore being easier to manufacture and maintain.

Suitably, the second end 17" of the rod 16 may divide the blind hole 35 in a first and a second variable volume compartment 51', 51" fluidly communicating and adjacent with each other.

This aim, the second end 17" of the rod 16 may include a cylindrical separation element 60 for separating the variable volume compartments 51', 51".

Figure 13A:
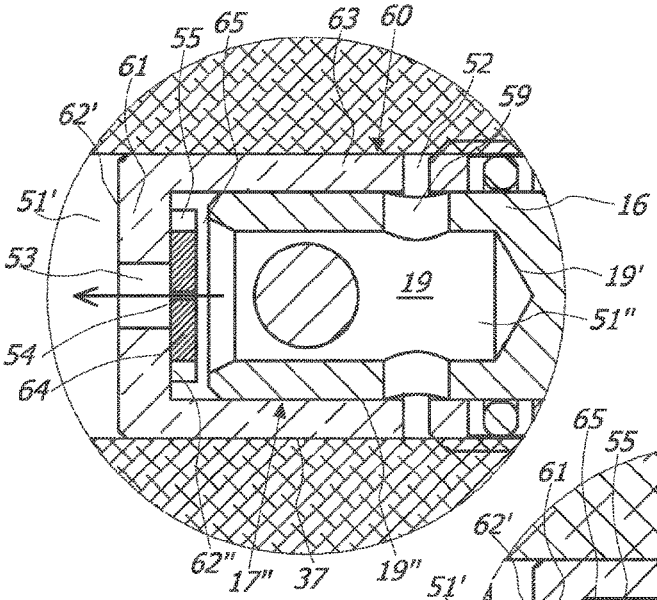
FIGS. 13*a* and 13*b* are enlarged details of the sections shown in FIGS. 11*a* and 11*b;*
Figure 13B:
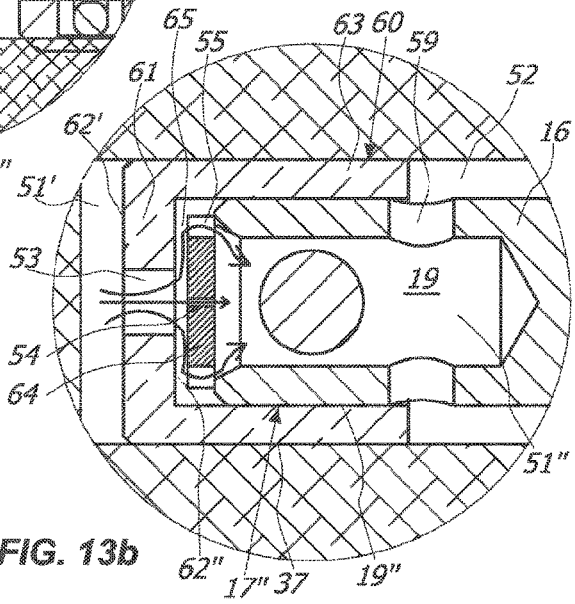
Figures 14, 15:
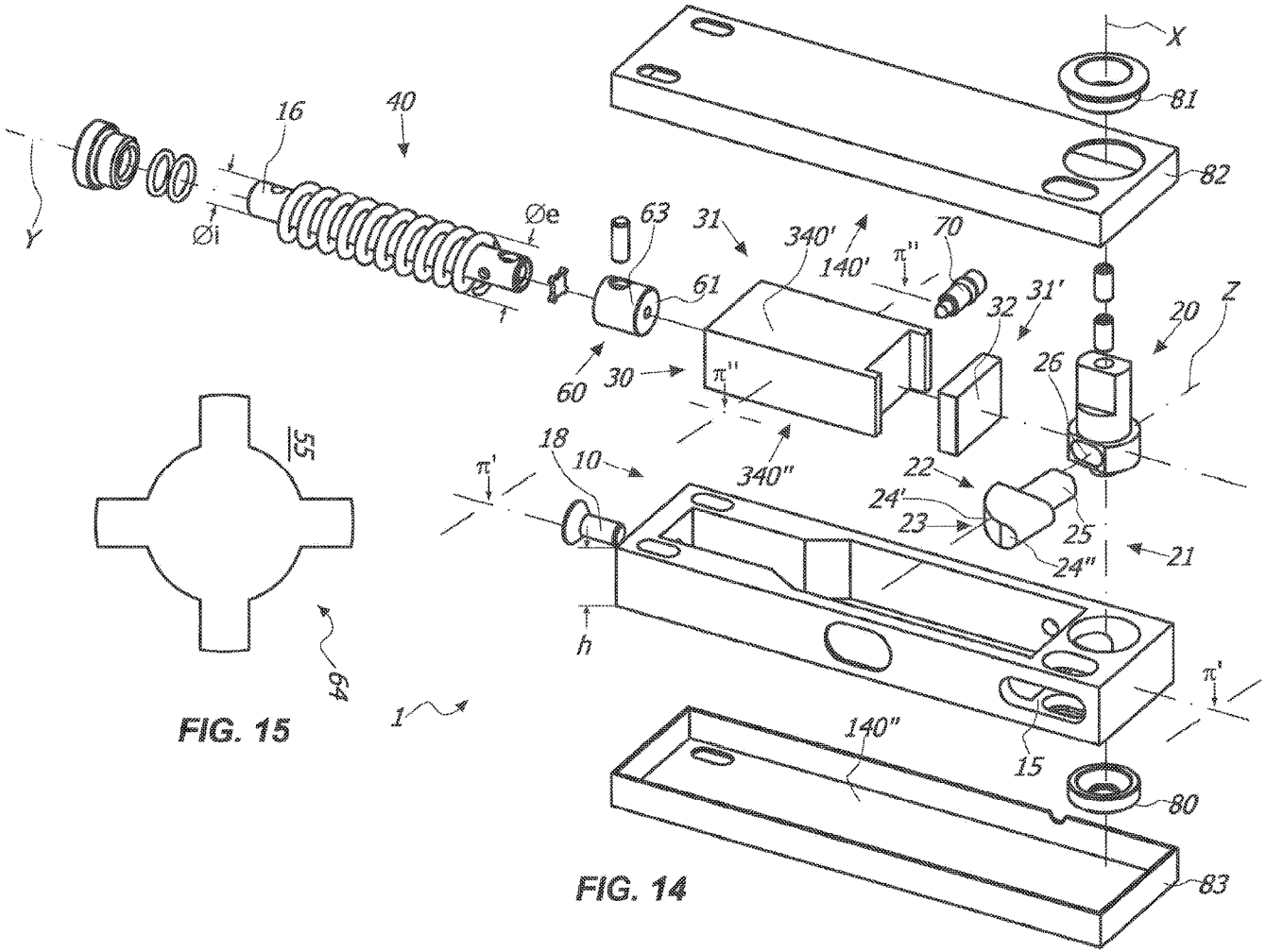
FIG. 14 is an exploded view of a sixth embodiment of the hinge 1.
FIG. 15 is a front view of the obstructing element 64 of the sixth embodiment of the hinge 1 of FIG. 14.
Figure 16A:
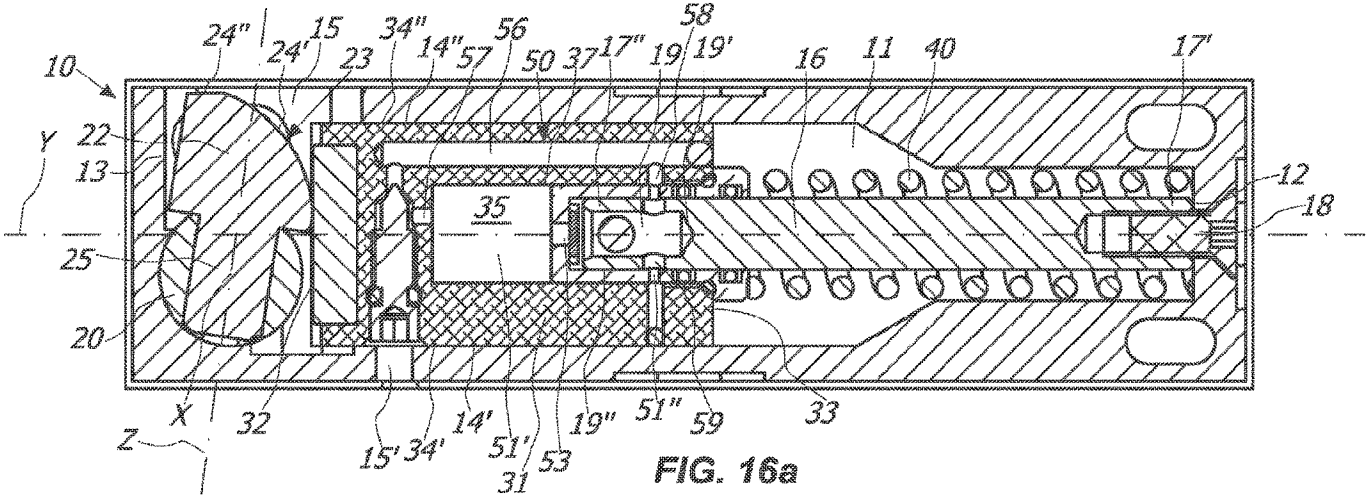
FIGS. 16*a* and 16*b* are views of the sixth embodiment of the hinge 1 of FIG. 14 sectioned along a plane π-π shown in FIG. 1, the slider 31 being respectively in the distal and proximal position.
Figure 16B:
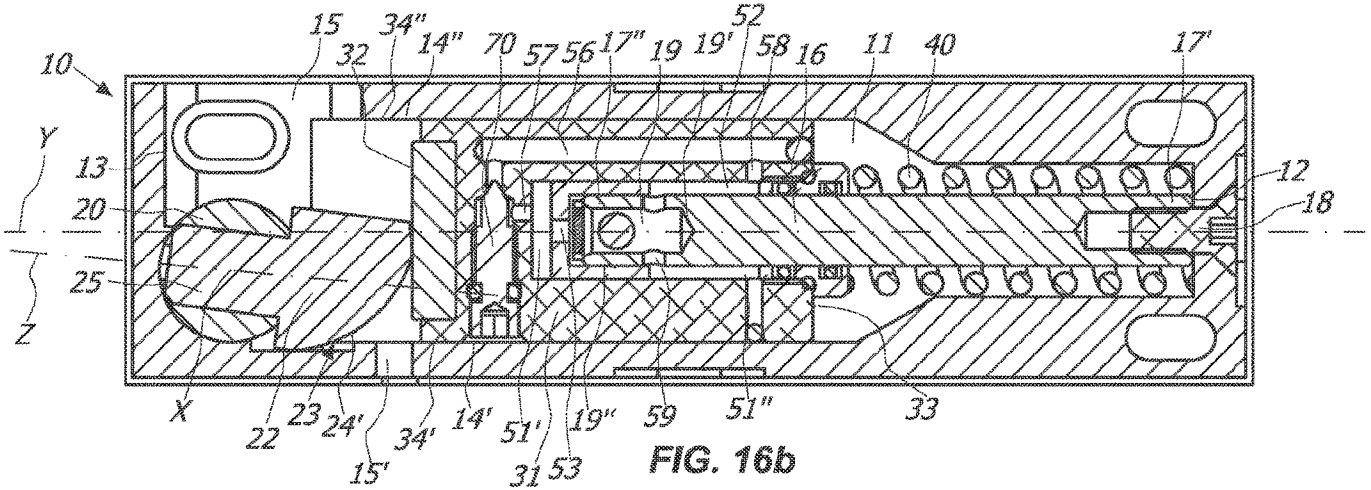

In a first preferred but not exclusive embodiment, shown for instance in FIGS. 13*a* and 13*b*, the cylindrical separation element 60 may be an open cylinder to be fitted over the second end 17" of the rod 16.

In an alternative preferred but not exclusive embodiment, shown in FIGS. 19*a* to 20*c*, the cylindrical separation element 60 may be a closed cylindrical element to be screwed onto the end 17" of the rod 16.

In any case, the separation element 60 may include an internal chamber 65 with a bottom wall 19', a side wall 63 and a front wall 61.

The latter may have a front face 62' faced to the bottom wall 36 of the blind hole 35 and a bottom face 62" faced to the bottom wall 19' of an axial blind hole 19 made at the second end 17" of the rod 16.

In the first embodiment shown for instance in FIGS. 13*a* and 13*b*, the cylindrical separation element 60 may have the cylindrical wall 63 interposed between the side wall 19" of the second end 17" of the rod 16 and the side wall 37 of the blind hole 35 of the slider to act as spacer between them. In this way, the same side walls 19", 37 defines a tubular air gap 52.

In that embodiment, the first compartment 51' may be defined by the bottom wall 36 of the axial blind hole 35, by the side wall 37 of the axial blind hole 35 and by the front face 62' of the front wall 61, while the second compartment 51" may be defined by the axial hole 19 of the rod 16 and by the tubular air-lock 52, being fluidly communicating with each other through the passage 59.

Particularly, as far as the second compartment 51" is concerned the axial blind hole 19 has a stable volume, while the tubular air gap 52 varies its volume when the slider 31 passes from the distal to the proximal position and vice-versa.

As particularly shown in FIG. 20*c*, in the other embodiment the first compartment 51' may be defined by the bottom wall 36 of the axial blind hole 35, by the side wall 37 of the axial blind hole 35 and by the front face 62' of the front wall 61, while the second compartment 51" may be defined by the interspace between the cylindrical separation element 60 and an oil seal 600 faced thereto and coupled to the slider 31 to close the axial blind hole 35.

The working fluid passes between the compartments 51', 51" through a chamber internal to the cylindrical separation element 60, the latter having a specific passage 59'.

Suitably, the compartments 51', 51" may be configured to have in correspondence to the closed position of the shutter A respectively the maximum and the minimum volume.

To allow the fluid communication between the two compartments 51', 51", controlling means for controlling the flow of the working fluid may be provided to allow its passage from the first compartment 51' to the second compartment 51" during one of the opening or the closing movement of the shutter A and to allow its passage from the second compartment 51" to the first compartment 51' during the other of the opening or closing movement of the shutter A.

In a preferred but not exclusive embodiment, the means for controlling the flow of the working fluid may comprise an opening 53 passing through the separation element 60 in correspondence to the wall 61 and valve means to allow the controlled passage of the working fluid between the two compartments 51', 51".

Suitably, the valve means may comprise an obstructing element 64 movable in a seat 65 defined by the internal chamber of the cylindrical separation element 60. The valve seat 65 may be interposed between the passing-through opening 53 and the blind hole 19 of the end 17" of the rod 16 and allows the obstructing element 64 to move between a first working position, shown for instance in FIGS. 11*a*, 13*a* and 16*a* in which the obstructing element 64 is in contact engage with the passing-through opening 53 and a second working position, shown for instance in FIGS. 11*b*, 13*b* and 16*b* in which the same obstructing element 64 is spaced apart therefrom.

In a first embodiment, shown for instance in FIGS. 10 to 13*b*, the obstructing element 64 may include a calibrated opening 54, preferably in a central position, to allow the passage of the working fluid between the two compartments 51', 52" through the passing-through opening 53 when the same obstructing element 64 is in the first working position.

The calibrated opening 54 may have a diameter less than 1 mm, and preferably less than 0.5 mm. Approximately, the calibrated opening 54 may have a diameter of 1 to 3 tenths of millimeter.

Therefore, when the obstructing element 64 is in the first working position, corresponding to the distal position of the slider 31 and to the rest position of the axis Z, the working fluid exclusively passes through the calibrated opening 54, while when the obstructing element 64 is in the second working position, corresponding to the proximal position of the slider 31 and to the working position of the axis Z, the working fluid passes both through the calibrated opening 54 and through a plurality of peripheral passages 55 thereto. In this embodiment, the hydraulic circuit 50 may therefore be entirely contained internally to the blind hole 35 of the slider 31.

In a preferred but not exclusive embodiment, the valve seat 65 may include a pin 650 passing through a hole 640 of the obstructing element 64.

In this case, the calibrated opening 54 may be defined by the interspace between the hole 640 of the obstructing element 64 and the passing-through pin 650.

In any case, the calibrated opening 54 may have a flow section less than 2 mm.sup.2, preferably less than 1 mm.sup.2, still more preferably less than 0.5 mm.sup.2 and ideally less than 0.35 mm.

Advantageously, the pin 650 may be inserted through a hole 610 of the front wall 61 of the chamber 65.

In this case, the passing-through opening 53 may be defined by the interspace between the hole 610 of the front wall 61 of the chamber 65 and the passing-trough pin 650.

Suitably, the pin 650 may be inserted through the obstructing element 64 and the front wall 61 of the chamber 65 to freely move along the axis Y.

This aim, the bottom wall 19' of the chamber 65 may include a seat for the pin 650, which seat may be defined by the axial blind hole 19.

Suitably, the pin 650 and the axial blind hole 19 may be reciprocally dimensioned so as in the distal position of the slider 31 the pin 650 retracts in its seat 19 upon the interaction with the bottom wall 36 of the blind hole 35, and in the proximal position of the slider 31 the pin 650 telescopically projects from the seat 19 by partially remaining inserted therein, so as not to slip.

Due to the above features, the free sliding of the pin 650 during the sliding of the slider 31 maintains the passing-through opening 53 and the calibrated opening 54 free from any dirt and/or foreign bodies, both openings having reduced dimensions.

In a second embodiment, shown for instance in FIGS. from 14 to 16*b*, the obstructing element 64 does not have the calibrated central hole 54. Therefore, when the obstructing element 64 is in the first working position the working fluid does not pass through the passing-through opening 53 of the cylindrical separation element 60.

To allow the fluid communication between the compartments 51', 51", when the obstructing element 64 is in the first working position, the hydraulic circuit 55 may include a branch 56 external to the blind hole 35 of the slider 31. In this case, the hydraulic circuit 50 may furthermore include a first opening 57 passing through the bottom wall 36 of the axial blind hole 35 to put in fluid communication the first variable volume compartment 51' and the branch 56 and a second opening 58 passing through the side wall 37 of the axial blind hole 36 to put in fluid communication the branch 56 and the tubular air gap 52. From here the working fluid passes in the axial blind hole 19 through the radial passage 59.

Suitably, the means for controlling the flow of the working fluid may comprise a adjusting element 70, for instance an adjusting screw, transversally inserted in the slider 31 to throttle the flow section of the first passing-through opening 57 of the circuit 50.

To allow an user to access the adjusting element 70, an opening 15' passing through the hinge body 10 may be provided, the former being suitably placed so as to allow the adjusting when the slider 31 is in distal position.

In this way, it is possible to regulate the hydraulic damping action of the hinge 1, and in particular the rotation speed of the shutter A.

In the embodiments herein shown the distal position of the slider 31, corresponding to the rest position of the axis Z, corresponds in turn to the closed position of the shutter A, while the proximal position of the slider 31, corresponding to the working position of the axis Z, corresponds in turn to the open position of the shutter A.

However, it is clear that the opposite is possible, that is the distal position of the slider 31 corresponds to the open position of the shutter A and the proximal position of the slider 31 corresponds to the closed position of the shutter A, without exceeding the scope of protection defined by the appended claims.

The hydraulic damping action of that embodiments provides for a controlled movement of the shutter A both during the opening and the closing movement. However, while in the embodiment shown in FIGS. 14 to 16*b* this action may be regulated through the adjusting screw 70, in the embodiment shown in FIGS. 10 to 13*b* the regulation of the damping is not possible.

Figure 21A:
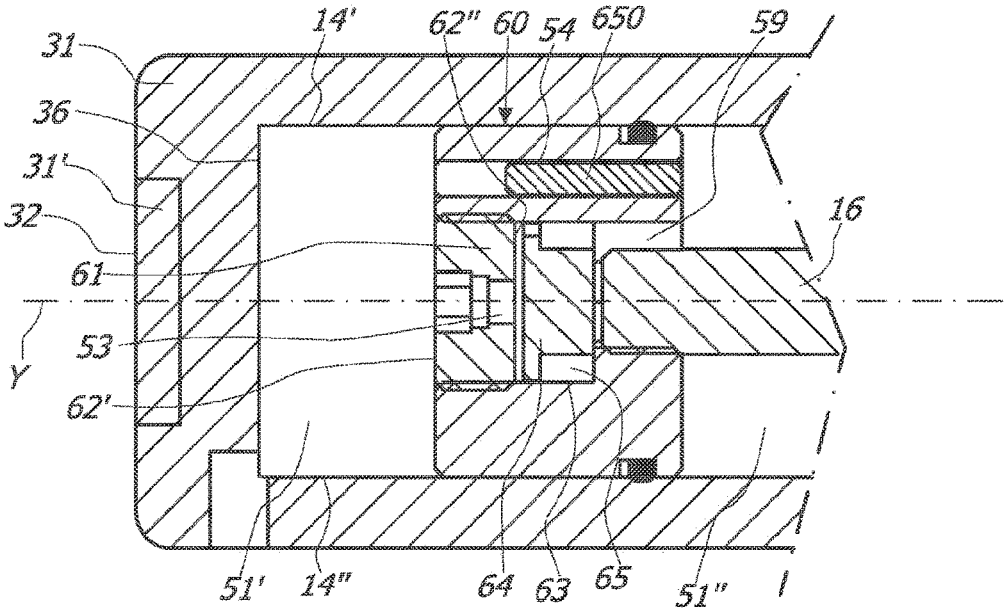
FIGS. 21*a* and 21*b* are sectioned views of a further embodiment of the hinge 1.
Figure 21B:
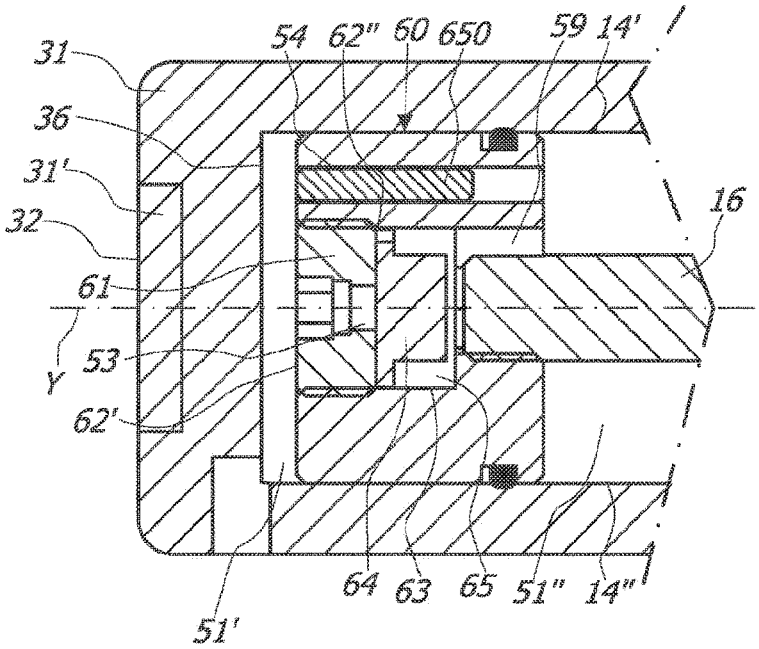

In a further embodiment, shown for instance in FIGS. 21*a* and 21*b*, the obstructing element 64 may not have the calibrated opening 54, the latter being defined by the air gap between the pin 650 and the relative seat 651 in which it is slidably inserted. Suitably, the seat 651 may pass through the cylindrical separation element 60, for instance in a peripheral position with respect to its centre.

The pin 650 and the seat 651 may be reciprocally configured so that the former freely moves through the latter. To this end, the pin 650 may for instance have a length less than that of the seat 651.

In this way, the sliding movement of the pin maintains the calibrated opening 54 free from any dirt and/or foreign bodies.

Suitably, anti-slipping means can be provided to avoid the slipping of the pin 650 from the seat 651 during the sliding. For instance, the seat 651 may have caulkings at the ends, acting as abutments for the pin 650.

It is clear that said embodiment may apply to any hinge, not necessarily to those shown in FIGS. 1 to 20*c*, without exceeding the scope of protection defined by the appended claims. For instance, said embodiment may apply to the hinge according to the international patent application WO2012/156949.

From the above description, it is apparent that the hinge fulfils the intended objects.

The hinge according to the invention is susceptible to numerous modifications and variants within the inventive concept expressed in the appended claims. All particulars may be replaced by other technically equivalent elements, and the materials may be different according to the needs, without exceeding the scope of protection defined by the appended claims.

Even though the hinge has been shown with particular reference to the appended figures, the numbers of reference used in the description and in the claims are used to ameliorate the intelligence of the invention and do not constitute a limit to the scope of protection claimed.

The invention claimed is:

1. A hydraulic hinge for rotatably moving and controlling a closing element anchored to a stationary support structure between an open position and a closed position, the hydraulic hinge comprising:

a hinge body anchorable to one of the stationary support structure or the closing element, the hinge body internally comprising a working chamber with a front wall and a bottom wall faced thereto;

a pivot defining a first longitudinal axis anchorable to the other one of the stationary support structure or the closing element, the pivot and the hinge body being reciprocally coupled to each other to rotate about a first axis between the open position and the closed position of the closing element;

a slider slidably movable within the working chamber along a second axis between a position distal from the bottom wall and a position proximal thereto, the pivot and the slider being reciprocally coupled so that a rotation of the closing element about the first axis corresponds to the at least partial sliding of the slider along the second axis;

a hydraulic damping system within the working chamber acting on the slider to hydraulically damp a movement of the closing element during opening or closing, the hydraulic damping system including a working fluid flowing in a hydraulic circuit; and a separation element inserted into the hydraulic circuit to divide the hydraulic circuit in at least one first and one second variable volume compartments fluidly communicating with each other, wherein the separation element includes at least one calibrated opening to put in fluid communication between the at least one first compartment and at least one second compartment and a pin passing therethrough, the at least one calibrated opening being defined by an interspace between the separation element and the pin.

2. The hydraulic hinge according to claim 1, wherein the pin is slidingly inserted in a seat passing through the separation element so as freely move therein, so that a sliding movement maintains the at least one calibrated opening free from dirt or foreign bodies.

3. The hydraulic hinge according to claim 2, further comprising an anti-slipping system provided in the seat to prevent a slipping of the pin from the seat during a sliding of the pin in the seat.

4. The hydraulic hinge according to claim 1, wherein the at least one calibrated opening has a flow section of less than 2 $mm^2$.

5. The hydraulic hinge according to claim 4, wherein the at least one calibrated opening has a flow section of less than 0.35 $mm^2$.

6. The hydraulic hinge according to claim 1, wherein the separation element further comprises at least one pass-through opening to put in fluid communication between the at least one first compartment and the at least one second compartment, and a valve member including an obstructing element interacting with the pass-through opening to allow a controlled passage of the working fluid between the at least one first compartment and the at least one second compartment, the valve member comprising a valve seat adapted to house the obstructing element interposed between the at least one first compartment and the at least one second compartment and in fluid communication therewith, wherein the obstructing element is slidably movable in the valve seat between a first working position, in which the obstructing element is in contact with the at least one pass-through opening, and a second working position, in which the obstructing element is spaced apart therefrom, and wherein when the obstructing element is in the first working position the working fluid passes through the at least one calibrated opening, and when the obstructing element is in the second working position the working fluid passes through the at least one calibrated opening and an interspace between the obstructing element and the at least one pass-through opening, the calibrated opening allowing a passage of the working fluid between the first and the second variable volume compartments both when the obstructing element is in the first working position and when the same obstructing element is in the second working position.

7. The hydraulic hinge according claim 6, wherein the obstructing element includes the at least one calibrated opening so as to allow the passage of the working fluid between the at least one first and second variable volume compartments through the at least one pass-through opening of the separation element both when the obstructing element is in the first working position and when the same obstructing element is in the second working position, and wherein, when the obstructing element is in the first working position, the working fluid passes exclusively through the at least one calibrated opening, and, when the obstructing element is in the second working position, the working fluid passes through the at least one calibrated opening and the interspace between the obstructing element and the at least one pass-through opening.

8. The hydraulic hinge according to claim 7, wherein the at least one calibrated opening belonging to the obstructing element is a single calibrated opening.

9. The hydraulic hinge according to claim 8, wherein the single calibrated opening is disposed in a central zone of the obstructing element.

10. The hydraulic hinge according to claim 8, wherein the pin is inserted through the obstructing element, the at least one calibrated opening being defined by the interspace between the obstructing element and the pin.

11. The hydraulic hinge according to claim 10, wherein the separation element includes a chamber defining the valve seat, the chamber having a bottom wall, a side wall and a front wall including the at least one pass-through opening, the pin being further inserted through the front wall of the chamber, the pass-through opening being defined by an interspace between the front wall of the chamber and the pin.

12. The hydraulic hinge according to claim 11, wherein the bottom wall of the chamber includes a seat for the pin, the seat being reciprocally dimensioned so that in a distal position the pin retracts within the seat upon an interaction with the bottom wall defining a blind hole, and wherein in a proximal position the pin telescopically projects from the seat by partially remaining inserted therein.

* * * * *